US007275364B2

(12) United States Patent
Tamura et al.

(10) Patent No.: US 7,275,364 B2
(45) Date of Patent: Oct. 2, 2007

(54) EXHAUST EMISSION CONTROL DEVICE OF INTERNAL COMBUSTION ENGINE

(75) Inventors: Yasuki Tamura, Tokyo (JP); Kazuhito Kawashima, Tokyo (JP); Hitoshi Toda, Tokyo (JP)

(73) Assignee: Mitsubishi Jidosha Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/550,520

(22) PCT Filed: Oct. 17, 2003

(86) PCT No.: PCT/JP03/13296

§ 371 (c)(1),
(2), (4) Date: Jul. 24, 2006

(87) PCT Pub. No.: WO2004/085819

PCT Pub. Date: Oct. 7, 2004

(65) Prior Publication Data

US 2007/0000482 A1 Jan. 4, 2007

(30) Foreign Application Priority Data

Mar. 26, 2003 (JP) ..... 2003-086288

(51) Int. Cl.
*F01N 3/00* (2006.01)

(52) U.S. Cl. ..... 60/285; 60/276; 60/286

(58) Field of Classification Search ..... 60/274, 60/276, 277, 285, 286
See application file for complete search history.

(56) References Cited

U.S. PATENT DOCUMENTS 4,744,344 A 5/1988 Morozumi
4,854,124 A * 8/1989 Tamura ..... 60/274
5,325,711 A * 7/1994 Hamburg et al. ..... 73/118.1
5,423,203 A * 6/1995 Namiki et al. ..... 73/1.06
6,003,308 A 12/1999 Tsutsumi et al.
6,371,096 B1 * 4/2002 Ohsaki et al. ..... 123/688
6,543,219 B1 * 4/2003 Surnilla ..... 60/285
7,059,120 B2 * 6/2006 Nakagawa et al. ..... 60/289

FOREIGN PATENT DOCUMENTS

| | | |
|---|---|---|
| DE | 198 44 994 C2 | 4/2000 |
| DE | 102 06 675 C1 | 5/2003 |
| DE | 102 43 342 B3 | 1/2004 |
| JP | 9-264177 A | 10/1997 |
| JP | 10-131790 A | 5/1998 |
| JP | 11-107831 A | 4/1999 |
| JP | 11-107871 | 4/1999 |

* cited by examiner

*Primary Examiner*—Binh Q. Tran
(74) *Attorney, Agent, or Firm*—Birch, Stewart, Kolasch & Birch, LLP

(57) ABSTRACT

The air/fuel ratio of exhaust flowing into a catalytic converter is forcibly modulated, between a lean air/fuel ratio leaner than a target average air/fuel ratio and a rich air/fuel ratio richer than the target average air/fuel ratio, with a specific period, a specific amplitude, a specific modulation ratio and a specific waveform. During the forcible modulation (S10, S12), the ratio of a time for which the output of an oxygen sensor is greater than a standard value Sb for the output set between the maximum and minimum values of the output ("rich" output time), or of a time for which it is smaller than the standard value Sb ("lean" output time), in a predetermined period of time, or a value correlating with this ratio is obtained (S14), and the air/fuel ratio of the exhaust is controlled on the basis of this ratio or the value correlating with this ratio (S16, S18).

16 Claims, 14 Drawing Sheets

EXHAUST EMISSION CONTROL DEVICE OF INTERNAL COMBUSTION ENGINE

BACKGROUND OF THE INVENTION

1. Field of the Invention

This invention relates to an exhaust purification device for internal combustion engine, specifically a technique of improving the purification performance of a catalytic converter by forcibly modulating the air/fuel ratio of exhaust.

2. Description of the Related Art

A three-way catalytic converter for exhaust purification using a noble metal such as platinum (Pt) or the like has a considerable capacity to store oxygen ($O_2$). When the air/fuel ratio of exhaust is lean (oxidizing atmosphere), it stores $O_2$ and thereby suppresses the production of $NO_x$, and when the air/fuel ratio of exhaust is rich (reducing atmosphere), it releases the $O_2$ stored and thereby accelerates the oxidation of HC and CO. By this, the exhaust purification performance improves.

Hence, in recent years, vehicles have been developed and put to practical use in which improvement in the exhaust purification performance of the three-way catalytic converter is intended by forcibly modulating the air/fuel ratio of exhaust between a lean air/fuel ratio and a rich air/fuel ratio, for example by switching the air/fuel ratio in the combustion chamber of the internal combustion engine between a lean air/fuel ratio leaner than a specific air/fuel ratio (stoichiometric air/fuel ratio, for example) and a rich air/fuel ratio richer than the specific air/fuel ratio, with a specific period and a specific amplitude.

Further, a device has been developed in which improvement of the forcible modulation control is intended by monitoring the air/fuel ratio of exhaust (referred to as "exhaust air/fuel ratio") by an exhaust sensor during the forcible modulation and performing feedback control so that the actual exhaust air/fuel ratio agrees with a target exhaust air/fuel ratio (see Japanese Unexamined Patent Publication No. hei 10-131790).

As exhaust sensors for detecting the exhaust air/fuel ratio, a wide-range air/fuel sensor (linear air/fuel ratio sensor (LAFS), for example) and an oxygen sensor ($O_2$ sensor, for example) are known. However, as disclosed in the above-mentioned Patent Document, in order to perform feedback control so that the actual exhaust air/fuel ratio agrees with a target exhaust air/fuel ratio, it is necessary to detect the exhaust air/fuel ratio over a wide range, accurately. Hence, in general, the wide-range air/fuel sensor is used to detect the actual exhaust air/fuel ratio.

However, while the wide-range air/fuel sensor can detect a wide range of air/fuel ratios, it has a drawback that its cost is very high. Hence it is not practical.

Meanwhile, the oxygen sensor is low in cost and therefore very advantageous for general frequent use. However, it has a non-linear output characteristic curve with respect to air/fuel ratio, so that the range of detectable air/fuel ratios is narrow. Hence, there is a problem such that, when the amplitude of the forcible modulation is increased to improve the exhaust purification performance, the exhaust air/fuel ratio exceeds the range of air/fuel ratios detectable by the oxygen sensor, so that the exhaust air/fuel ratio cannot be detected accurately on the basis of the output from the oxygen sensor.

SUMMARY OF THE INVENTION

The present invention provides an exhaust purification device for internal combustion engine in which the exhaust purification performance is improved by improving the accuracy of control on the exhaust air/fuel ratio in the forcible modulation of the exhaust air/fuel ratio using a low-cost exhaust sensor.

In order to achieve this object, an exhaust purification device according to this invention comprises a catalytic converter provided in an exhaust passage of an internal combustion engine; an air/fuel ratio forcibly modulating element for forcibly modulating the air/fuel ratio of exhaust flowing into the catalytic converter, between a lean air/fuel ratio leaner than a target average air/fuel ratio and a rich air/fuel ratio richer than the target average air/fuel ratio, with a specific period, a specific amplitude, a specific modulation ratio and a specific waveform; an oxygen sensor provided in the exhaust passage for detecting the oxygen concentration of the exhaust and supplying an output corresponding to the detected oxygen concentration; a time ratio calculating element for obtaining the ratio of a time for which the output of the oxygen sensor is greater than a standard value for the output set between the maximum and minimum values of the output ("rich" output time), or of a time for which the output of the oxygen sensor is smaller than the standard value for the output ("lean" output time), in a predetermined period of time, or a value correlating with this ratio; and an air/fuel ratio adjusting element for adjusting the air/fuel ratio of the exhaust during the forcible modulation, on the basis of the ratio or the value correlating with the ratio obtained by the time ratio calculating element.

Specifically, in the exhaust purification device according to this invention, improvement in the exhaust purification performance is intended by utilizing the oxygen storage function of the catalytic converter in a manner that the air/fuel ratio forcibly modulating element forcibly modulates the exhaust air/fuel ratio, between a lean air/fuel ratio and a rich air/fuel ratio, with a specific period, a specific amplitude and a specific waveform. During the forcible modulation, the time ratio calculating element obtains the ratio of a time for which the output of the oxygen sensor is greater than a standard value for the output set between the maximum and minimum values of the output, or of a time for which the output of the oxygen sensor is smaller than the standard value for the output, in a predetermined period of time, or a value correlating with this ratio. On the basis of this ratio or the value correlating with this ratio, the exhaust air/fuel ratio during the forcible modulation is properly adjusted by the air/fuel ratio adjusting element.

Generally, the oxygen sensor has a response delay. Hence, in the forcible modulation, when the actual exhaust air/fuel ratio varies describing a square wave, for example, the output of the oxygen sensor tends to vary describing a gently curved (non-square) wave in a delayed manner. Hence, provided that the standard value for the output of the oxygen sensor is set between the maximum and minimum values of the output thereof, when the average exhaust air/fuel ratio departs from a target average air/fuel ratio during the forcible modulation and the wave which the output of the oxygen sensor describes (referred to as "output wave") shifts along the axis representing the output (in the vertical direction) as a whole, the times at which the output wave intersects with the line representing the standard value change. Consequently, the ratio of the time for which the output of the oxygen sensor is greater than the standard value for the output, or of the time for which the output of the oxygen sensor is smaller than the standard value for the output, in a predetermined period of time (the period of the forcible modulation, for example), or the value correlating with the ratio changes. This feature based on the response delay can be utilized reversely. Specifically, by detecting the change of the above-mentioned time ratio or the value correlating with the time ratio, how much the oxygen sensor output wave has shifted along the axis representing the output, and therefore, how much the average exhaust air/fuel ratio has departed from the target average air/fuel ratio can be easily detected. On the basis of the amount by which the oxygen sensor output wave has shifted or the amount by which the average exhaust air/fuel ratio has departed from the target average air/fuel ratio, the average exhaust air/fuel ratio can be adjusted to the target average air/fuel ratio, properly.

Consequently, although the inexpensive exhaust sensor is used, the accuracy of the control on the exhaust air/fuel ratio in the forcible modulation can be improved, and therefore the exhaust purification performance of the catalytic converter can be improved.

The above-mentioned predetermined period of time is desirably an integer times the period of the modulation.

The output of the oxygen sensor varies periodically according to the period of the modulation. Hence, when the predetermined period of time is the period of the forcible modulation or an integer times the period of the modulation, the ratio of the time for which the output of the oxygen sensor is greater than the standard value for the output, or of the time for which it is smaller than the standard value, in relation to such period of time is reliable, and the value correlating with such ratio is also reliable. On the basis of such reliable ratio or correlating value, how much the oxygen sensor output wave has shifted along the axis representing the output, and how much the average exhaust air/fuel ratio has departed from the target average air/fuel ratio can be detected accurately. Hence, the average exhaust air/fuel ratio can be adjusted to the target average air/fuel ratio, properly.

Consequently, the accuracy of the control on the exhaust air/fuel ratio in the forcible modulation can be improved as desired.

It is desirable that the period of the modulation be set to be equal to or shorter than a maximum period which ensures that the air/fuel ratio to be detected on the basis of the output of the oxygen sensor does not reach the upper or lower limit of a range of air/fuel ratios detectable by the oxygen sensor.

When the exhaust air/fuel ratio exceeds the range of air/fuel ratios detectable by the oxygen sensor, the output of the oxygen sensor plateaus, so that the air/fuel ratio cannot be detected accurately. However, during the forcible modulation, due to the response delay, the output of the oxygen sensor tends to indicate a value smaller than the actual air/fuel ratio. Hence, provided that the period of the modulation is made short enough to ensure that the air/fuel ratio to be detected on the basis of the output of the oxygen sensor does not reach the upper or lower limit of the range of air/fuel ratios detectable by the oxygen sensor, the exhaust air fuel ratio can be detected properly even by the oxygen sensor, so that the average exhaust air/fuel ratio can be adjusted properly, according to its true value.

Specifically, since the change of the time ratio or the value correlating with the time ratio can be detected more properly, the average exhaust air/fuel ratio can be adjusted to the target average air/fuel ratio, more properly. Thus, although the inexpensive exhaust sensor is used, the accuracy of the control on the exhaust air/fuel ratio in the forcible modulation can be further improved.

It is desirable that the air/fuel ratio forcibly modulating element perform the forcible modulation so that the output of the oxygen sensor varies passing through a switch point of an output characteristic curve of the oxygen sensor.

In this case, it is desirable that the standard value for the output be set to an output value at the switch point or in the vicinity of the switch point.

Specifically, although the output of the oxygen sensor can vary due to aging or the like, the degree of such variation due to aging or the like is smallest in the vicinity of the switch point (inflection point) of the output characteristic curve of the oxygen sensor. Hence, by setting the standard value for the output to an output value in the vicinity of the switch point, the ratio of the time for which the output of the oxygen sensor is greater than the standard value for the output, or of the time for which it is smaller than the standard value for the output, in the predetermined period of time, or the value correlating with the ratio can be always obtained properly.

As mentioned above, the oxygen sensor has a response delay. Hence, for example, when the period of the forcible modulation is too short, the output of the oxygen sensor can vary in a range not containing the switch point of the output characteristic curve of the oxygen sensor. However, when the period of the forcible modulation is set to be equal to or longer than a minimum period which ensures that the output of the oxygen sensor varies passing through the switch point, the output of the oxygen sensor varies passing through the switch point. In this case, if the standard value for the output is set to an output value in the vicinity of the switch point, the time ratio or the value correlating with the time ratio can be always obtained properly.

It is desirable that the air/fuel ratio adjusting element adjust the air/fuel ratio of the exhaust during the forcible modulation, on the basis of a difference between the ratio or the value correlating with the ratio obtained by the time ratio calculating element and a standard value for the ratio.

Specifically, by detecting the difference between the time ratio or the value correlating with the time ratio and the standard value for the ratio, how much the oxygen sensor output wave has shifted along the axis representing the output, and therefore, how much the average exhaust air/fuel ratio has departed from the target average air/fuel ratio can be easily detected. On the basis of this difference between the time ratio or the value correlating with the time ratio and the standard value for the ratio, the average exhaust air/fuel ratio can be adjusted to the target average air/fuel ratio, properly.

It is desirable that the value correlating with the ratio be obtained, when the ratio is greater than the standard value for the ratio, by correcting the ratio in a manner such that the ratio is more increased when the period of the modulation is longer and more decreased when the period of the modulation is shorter, and when the ratio is smaller than the standard value for the ratio, by correcting the ratio in a manner such that the ratio is more decreased when the period of the modulation is longer and more increased when the period of the modulation is shorter.

Further, it is desirable that the value correlating with the ratio be obtained, when the ratio is greater than the standard value for the ratio, by correcting the ratio in a manner such that the ratio is more increased when the amplitude of the modulation is greater and more decreased when the amplitude of the modulation is smaller, and when the ratio is smaller than the standard value for the ratio, by correcting the ratio in a manner such that the ratio is more decreased when the amplitude of the modulation is greater and more increased when the amplitude of the modulation is smaller.

Further, it is desirable that the value correlating with the ratio be obtained, when the ratio is greater than the standard value for the ratio, by correcting the ratio in a manner such that the ratio is more increased when the waveform of the modulation is closer to a square wave and more decreased when the waveform of the modulation is further from the square wave, and when the ratio is smaller than the standard value for the ratio, by correcting the ratio in a manner such that the ratio is more decreased when the waveform of the modulation is closer to the square wave and more increased when the waveform of the modulation is further from the square wave.

Further, it is desirable that the exhaust purification device further comprise a rotational speed detecting element for detecting the rotational speed of the internal combustion engine, and that the value correlating with the ratio be obtained, when the ratio is greater than the standard value for the ratio, by correcting the ratio in a manner such that the ratio is more increased when the rotational speed of the internal combustion engine detected by the rotational speed detecting element is higher and more decreased when the rotational speed is lower, and when the ratio is smaller than the standard value for the ratio, by correcting the ratio in a manner such that the ratio is more decreased when the rotational speed is higher and more increased when the rotational speed is lower.

Further, it is desirable that the exhaust purification device further comprise an exhaust flow rate detecting element for detecting the flow rate of the exhaust, and that the value correlating with the ratio be obtained, when the ratio is greater than the standard value for the ratio, by correcting the ratio in a manner such that the ratio is more increased when the flow rate of the exhaust detected by the exhaust flow rate detecting element is greater and more decreased when the flow rate of the exhaust is smaller, and when the ratio is smaller than the standard value for the ratio, by correcting the ratio in a manner such that the ratio is more decreased when the flow rate of the exhaust is greater and more increased when the flow rate of the exhaust is smaller.

Specifically, it is known that the relation between the time ratio and the average exhaust air/fuel ratio is affected by the rotational speed of the internal combustion engine, the flow rate of the exhaust, and the amplitude, period and waveform of the modulation. Hence, when the average exhaust air/fuel ratio is obtained on the basis of the time ratio, the obtained value can differ from the true value. However, when a value correlating with the time ratio is obtained by correcting the time ratio depending on the rotational speed of the internal combustion engine, the flow rate of the exhaust, and the amplitude, period and waveform of the modulation, the average exhaust air/fuel ratio can be properly adjusted to the target air/fuel ratio, for example on the basis of a difference between the value correlating with the time ratio, thus obtained, and the standard value for the ratio.

Here, in place of or in addition to correcting the time ratio, the air/fuel ratio obtained from the time ratio, a value correlating with this air/fuel ratio, a target for the air/fuel ratio, a value correlating with this target for the air/flow ratio, a target for the time ratio or a value correlating with this target for the time ratio may be corrected. When the air/fuel ratio obtained from the time ratio or the value correlating with it is corrected, it is corrected to be richer or leaner. It is to be noted that when the target for the air/fuel ratio, the value correlating with this target for the air/fuel ratio, the target for the time ratio or the value correlating with this target for the time ratio is corrected, the correction is made in the opposite direction to when the air/fuel ratio obtained from the time ratio, the value correlating with this air/fuel ratio, the time ratio or the value correlating with the time ratio is corrected. Specifically, the target or the value correlating with the target is corrected to be "smaller" instead of "greater", "greater" instead of "smaller", "leaner" instead of "richer" or "richer" instead of "leaner". Further, the time for which the output of the oxygen sensor is greater than the standard value for the output ("rich" output time) or the time for which the output of the oxygen sensor is smaller than the standard value for the output ("lean" output time) can be used as a value correlating the time ratio. In this case, it is desirable that similar correction be made to the "rich" output time or the "lean" output time.

It is desirable that the standard value for the ratio of the time for which the output of the oxygen sensor is greater than the standard value for the output, or for the value correlating with this ratio be in the range of 0.5 to 0.75. Alternatively, it is desirable that the standard value for the ratio of the time for which the output of the oxygen sensor is smaller than the standard value for the output, or for the value correlating with this ratio be in the range of 0.25 to 0.5.

Specifically, it is known that when the time ratio is close to 0.5, the time ratio is hardly affected by the rotational speed of the internal combustion engine, the flow rate of the exhaust, and the amplitude, period and waveform of the modulation. Hence, when the target air/fuel ratio is a slightly rich air/fuel ratio so that the standard value for the ratio of the time for which the output of the oxygen sensor is greater than the standard value for the output, or for the value correlating with this ratio is in the range of 0.5 to 0.75 or the standard value for the ratio of the time for which the output of the oxygen sensor is smaller than the standard value for the output, or for the value correlating with this ratio is in the range of 0.25 to 0.5, it is possible to adjust the average exhaust air/fuel ratio to the slightly rich target air/fuel ratio, minimizing the influence of the rotational speed of the internal combustion engine, the flow rate of the exhaust, and the amplitude, period and waveform of the modulation. Here, by using an oxygen sensor having a catalytic function, the average exhaust air/fuel ratio can be adjusted to the slightly rich target air/fuel ratio with high accuracy and certainty.

By this, the catalytic converter's capacity to convert $NO_x$ can be particularly improved while its capacity to convert HC and CO is ensured.

It is desirable that the air/fuel ratio forcibly modulating element include a change element for making change according to the operating states of the internal combustion engine, and that the time ratio calculating element store changed periods of the modulation in the past, and obtain the value correlating with the ratio, from the time for which the output of the oxygen sensor is greater than the standard value for the output or the time for which the output of the oxygen sensor is smaller than the standard value for the output, obtained this time ("rich" output time or "lean" output time obtained this time), and a past changed period of the modulation stored.

Alternatively, it is desirable that the air/fuel ratio forcibly modulating element include a change element for making change according to the operating states of the internal combustion engine, and that the time ratio calculating element store the time for which the output of the oxygen sensor was greater than the standard value for the output or the time for which the output of the oxygen sensor was smaller than the standard value for the output, obtained last time ("rich" output time or "lean" output time obtained last time), and obtain the value correlating with the ratio, from the time for which the output of the oxygen sensor is greater than the standard value for the output, obtained this time ("rich" output time obtained this time), and the sum of the time for which the output of the oxygen sensor is greater than the standard value for the output, obtained this time ("rich" output time obtained this time) and the time for which the output of the oxygen sensor was smaller than the standard value for the output, obtained last time ("lean" output time obtained last time), or from the time for which the output of the oxygen sensor is smaller than the standard value for the output, obtained this time ("lean" output time obtained this time), and the sum of the time for which the output of the oxygen sensor is smaller than the standard value for the output, obtained this time ("lean" output time obtained this time) and the time for which the output of the oxygen sensor was greater than the standard value for the output, obtained last time ("rich" output time obtained last time).

By this, even when the period of the modulation is changed according to the operating states of the internal combustion engine but the period of variation (modulation) of the exhaust actually reaching the oxygen sensor or detected by the oxygen sensor differs from the set period of the modulation due to the delay of the exhaust system, such difference caused by the delay of the exhaust system is diminished to prevent deterioration in the accuracy of the control.

DETAILED DESCRIPTION OF THE INVENTION

First, a first embodiment of the present invention will be described.

Figure 1:
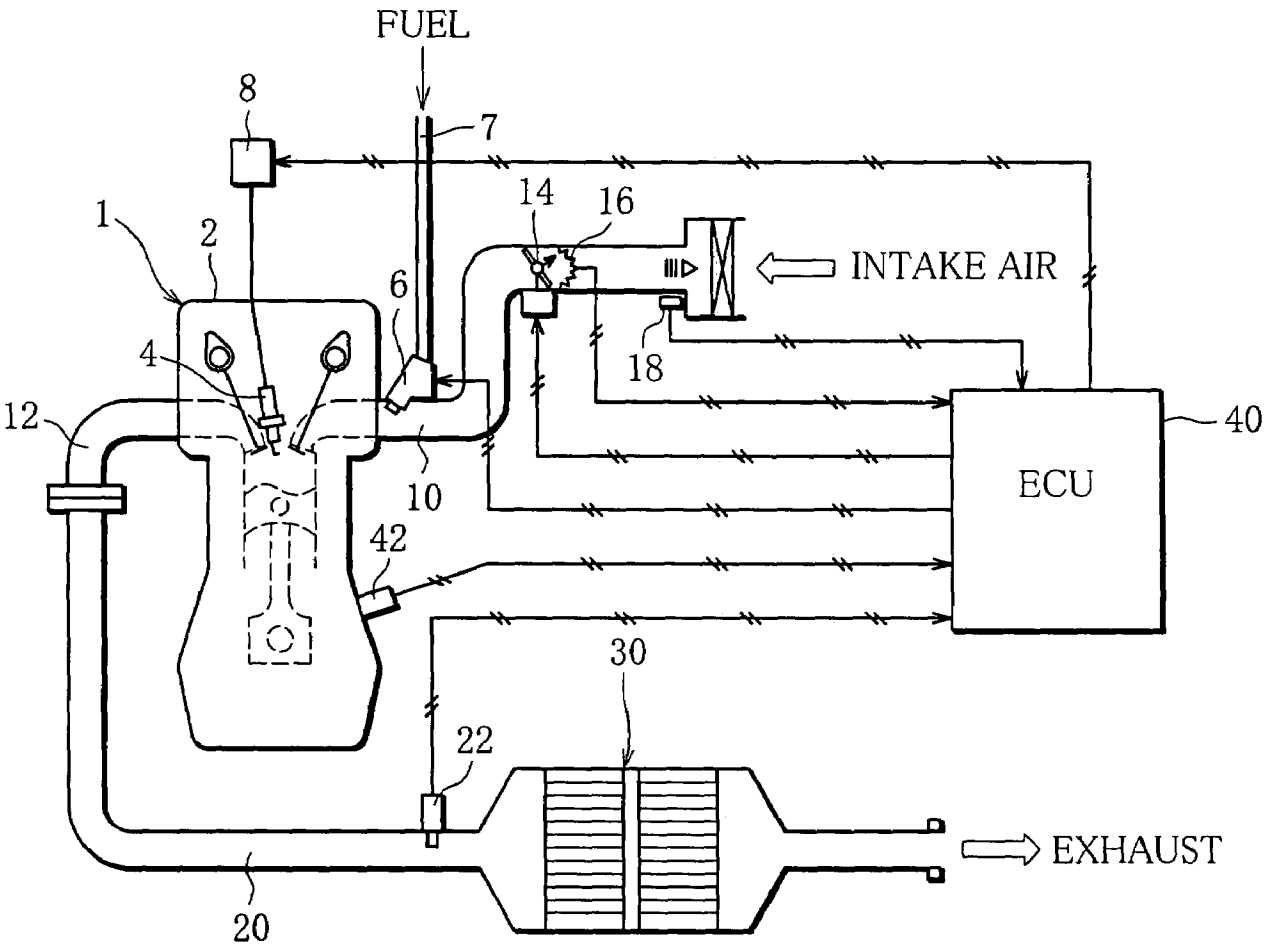
FIG. 1 is a schematic diagram showing the structure of an exhaust purification device for internal combustion engine according to this invention.

FIG. 1 is a schematic diagram showing the structure of an exhaust purification device for internal combustion engine according to this invention, installed in a vehicle. The structure of this exhaust purification device will be described below.

As shown in the figure, as a body 1 of an engine (hereinafter referred to simply as "engine") which is an internal combustion engine, a multi point injection (MPI) gasoline engine is used.

An ignition plug 4 for each cylinder is attached to a cylinder head 2 of the engine 1, and an ignition coil 8 for applying a high voltage is connected to each ignition plug 4.

The cylinder head 2 of the engine 1 has intake ports formed for each of the cylinders, and an intake manifold 10 is connected with the intake ports at one end. To the intake manifold 10, a solenoid-operated fuel injection valve 6 is attached, and a fuel pipe 7 connects the fuel injection valve 6 with a fuel supply device (not shown) including a fuel tank.

In the intake manifold 10, upstream of the fuel injection valve 6, a solenoid-operated throttle valve 14 for controlling the amount of intake air and a throttle position sensor (TPS) 16 for detecting the opening θth of the throttle valve 14 are provided. Further, upstream of the throttle valve 14, an air flow sensor 18 for measuring the amount of intake air is provided. For the air flow sensor 18, a Karman vortex air flow sensor is used. On the basis of the amount of intake air detected by the air flow sensor 18, also the flow rate of exhaust is detected (exhaust flow rate detecting element).

The cylinder head 2 also has exhaust ports formed for each of the cylinders, and an exhaust manifold 12 is connected with the exhaust ports at one end.

Since the MPI engine is known, the description of the details of its structure will be omitted.

At the other end, the exhaust manifold is connected with an exhaust pipe 20. In the exhaust pipe 20, a three-way catalytic converter 30 is provided as an exhaust purification catalytic device.

The three-way catalytic converter 30 has, on a catalyst support, any of copper (Cu), cobalt (Co), silver (Ag), platinum (Pt), rhodium (Rh) and palladium (Pd), as an active noble metal. Whether or not the catalytic converter includes an oxygen-storing substance such as cerium (Ce) or zirconium (Zr), the active noble metal has a capacity to store oxygen ($O_2$ storage function). Hence, when the three-way catalytic converter 30 absorbs oxygen ($O_2$) in an oxidizing atmosphere having a lean exhaust air/flow ratio (air/fuel ratio will be abbreviated as "A/F ratio"), the three-way catalytic converter 30 keeps the $O_2$ stored until the exhaust A/F ratio becomes rich, namely the atmosphere becomes a reducing atmosphere. With this $O_2$ stored, even in the reducing atmosphere, HC (carbon hydride) and CO (carbon monoxide) can be oxidized and removed. Thus, in the oxidizing atmosphere, the three-way catalytic converter 30 can not only convert HC and CO but also suppress the production of $NO_x$ to some degree, and in the reducing atmosphere, it can not only convert $NO_x$ but also convert HC and CO with the stored $O_2$ to some degree.

Figure 2:
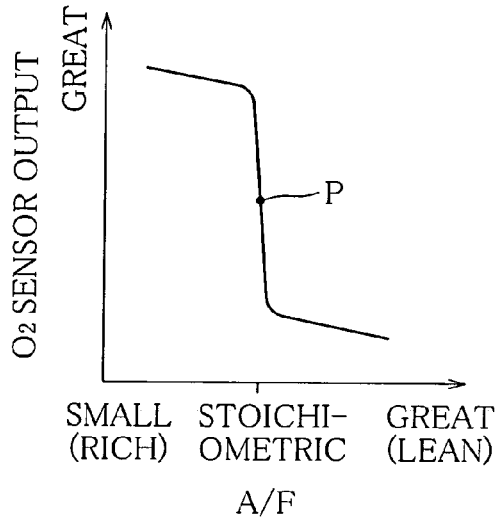
FIG. 2 is a diagram showing the output characteristic curve of an $O_2$ sensor with respect to air/fuel ratio (abbreviated as "A/F ratio")

In the exhaust pipe 20, upstream of the three-way catalytic converter 30, an $O_2$ sensor (oxygen sensor) 22 for detecting the oxygen concentration of exhaust is provided. The $O_2$ sensor has an output characteristic curve with respect to A/F ratio as shown in FIG. 2, and is known as an inexpensive exhaust sensor.

An ECU (electronic control unit) 40 includes an input/out device, a storage device (ROM, RAM, nonvolatile RAM, etc.), a central processing unit (CPU), a timer counter, etc. By the ECU 40, general control on the exhaust purification device including control on the engine 1 is performed.

To the input of the ECU 40, various sensors including the above-mentioned TPS 16, air flow sensor 18 and $O_2$ sensor 22, and a crank angle sensor 42 for detecting the crank angle in the engine 1, etc. are connected, and information detected by these sensors is supplied. It is to be noted that on the basis of crank-angle information supplied from the crank angle sensor 42, the engine speed Ne is detected (rotational speed detecting element).

To the output of the ECU 40, various output devices including the above-mentioned fuel injection valve 6, ignition coils 8 and throttle valve 14 are connected. To these output devices, fuel injection quantity, fuel injection timing, ignition timing, etc. calculated on the basis of the information detected by the sensors are supplied. Specifically, on the basis of the information detected by the sensors, an appropriate target for air/fuel ratio (target A/F ratio) is set, fuel in the amount suitable for this target A/F ratio is injected through the fuel injection valve 6 at an appropriate timing, the throttle valve 14 is adjusted to an appropriate opening, and spark ignition is performed by each ignition plug 4 at an appropriate timing.

In this exhaust purification device, considering that the three-way catalytic converter 30 has the $O_2$ storage function, in order that the three-way catalytic converter 30 can fully exert its ability, forcible modulation control for making the A/F ratio periodically vary between a specific rich A/F ratio richer than a target average A/F ratio and a specific lean A/F ratio leaner than the target average A/F ratio is performed by the ECU 40 in normal operation. Specifically, the modulation control is so performed as to keep the A/F ratio in the combustion chamber (combustion A/F ratio) at a specific lean A/F ratio for a specific time and then at a specific rich A/F ratio for a specific time to thereby modulate the exhaust A/F ratio between a specific lean A/F ratio and a specific rich A/F ratio periodically, with a specific amplitude, a specific period and a specific waveform (air/fuel ratio forcibly modulating element). The waveform of the modulation is not limited to a square wave. It may be a triangular wave, a sinusoidal wave, or another curved wave.

By this, in the oxidizing atmosphere having a lean exhaust A/F ratio, HC and CO are converted well, and the production of $NO_x$ is suppressed to some degree since $O_2$ is stored by the $O_2$ storage function of the three-way catalytic converter 30; and in the reducing atmosphere having a rich exhaust A/F ratio, $NO_x$ is converted well, and HC and CO is converted more or less continuously with the $O_2$ stored. Thus, the exhaust purification performance of the three-way catalytic converter 30 is improved.

Figure 3:
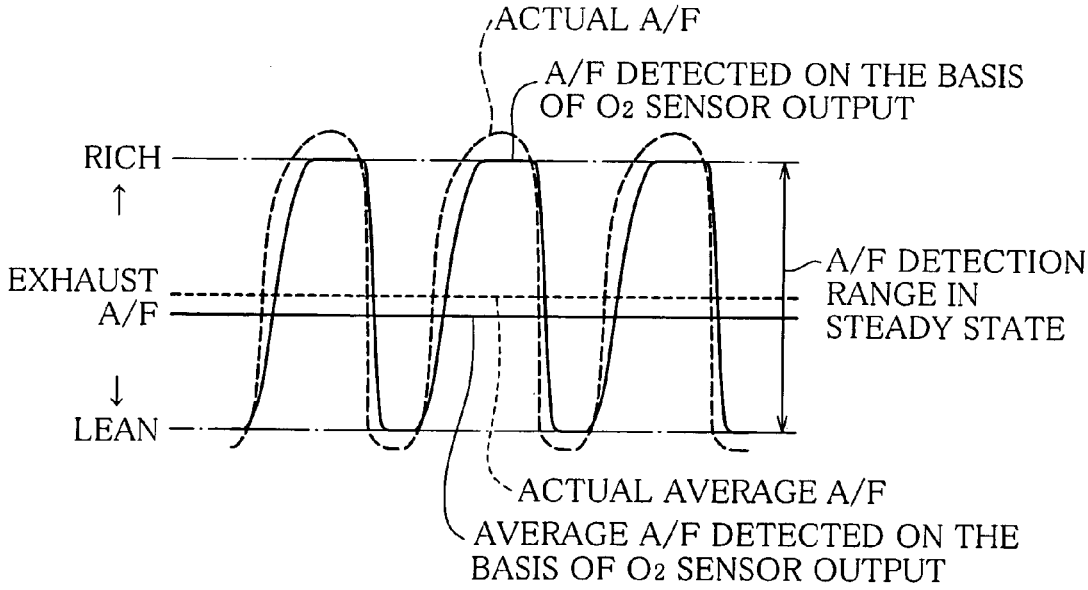
FIG. 3 shows the exhaust A/F ratio detected on the basis of the output of an $O_2$ sensor (solid curve), when, in forcible modulation, the actual A/F ratio (dashed curve) exceeds the range of A/F ratios detectable by the $O_2$ sensor in its steady state, so that the output of the $O_2$ sensor plateaus at the limits of the range of detectable A/F ratios.

When the forcible modulation of the A/F ratio like this is performed in the engine 1, in order to improve the exhaust purification performance of the three-way catalytic converter 3, it is desirable to monitor the exhaust A/F ratio by the $O_2$ sensor 22 and perform the A/F ratio control so that the average exhaust A/F ratio always agrees with a target for it (target average A/F ratio). However, as mentioned above, since the $O_2$ sensor has a non-linear output characteristic curve with respect to A/F ratio, the range of A/F ratios detectable by the $O_2$ sensor (A/F ratio detection range) is narrow. As shown in FIG. 3, when the amplitude of the forcible modulation is increased to improve the exhaust purification performance, the actual A/F ratio exceeds the A/F ratio detection range for the $O_2$ sensor in its steady state (as shown by the dashed line), so that the output of the $O_2$ sensor plateaus at the limits of the A/F ratio detection range, so that the exhaust A/F ratio cannot be detected accurately (as shown by the solid line). Consequently, the average A/F ratio detected on the basis of the output of the $O_2$ sensor (shown by the solid line) differs from the actual average A/F ratio (shown by the dashed line), which means that the average A/F ratio cannot accurately be detected on the basis of the output of the $O_2$ sensor.

The exhaust purification device according to this invention is designed to solve the problem like this. Next, how the air/fuel ratio forcible modulation is performed in the exhaust purification device according to this invention having the above-described structure will be described.

Figure 4:
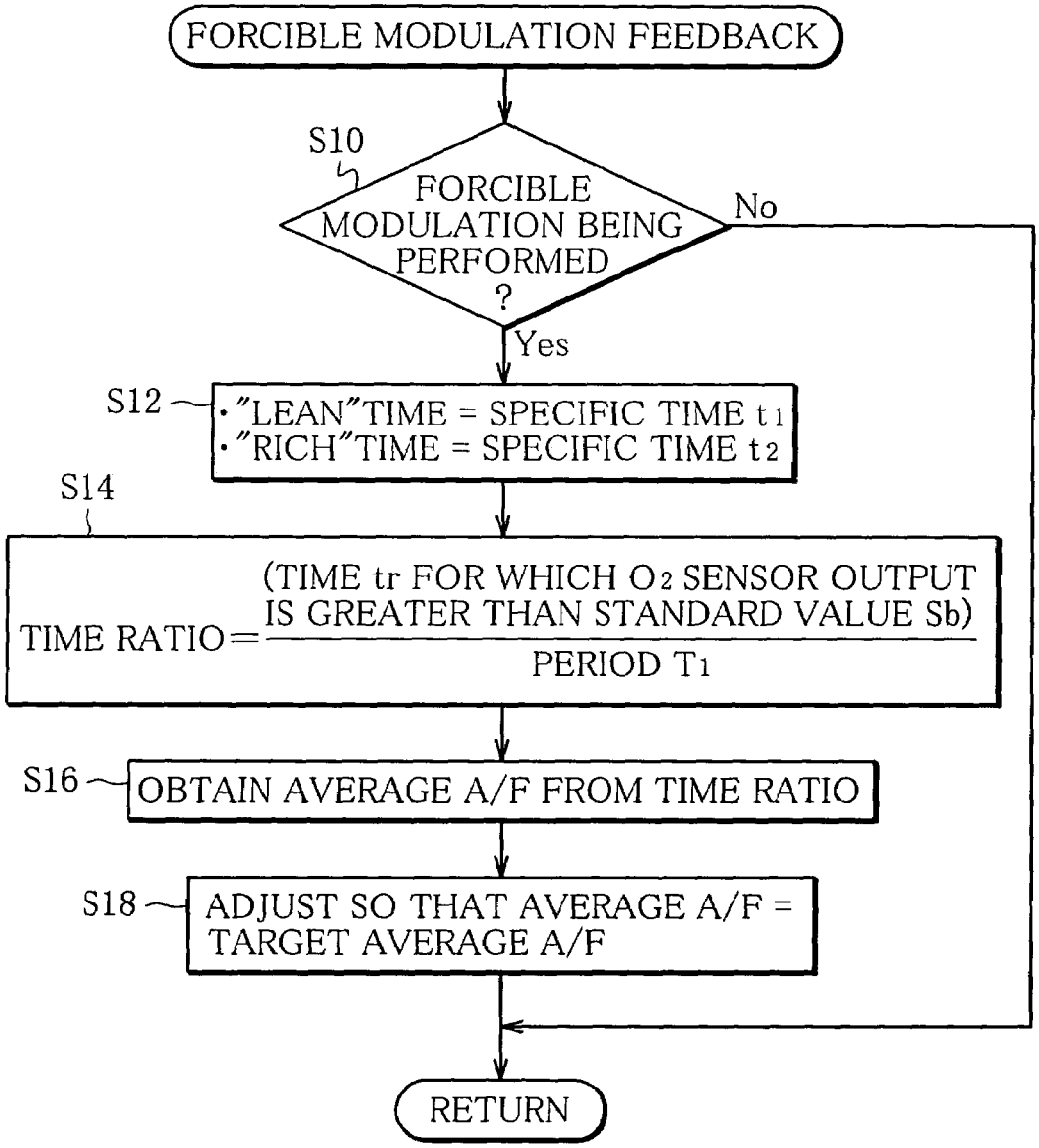
FIG. 4 is a flow chart showing a control routine for forcible modulation feedback control in a first embodiment of this invention.

FIG. 4 shows a control routine for forcible modulation feedback control in a first embodiment of the present invention, in the form of a flow chart. The description below will be given according to this flow chart.

In step S10, whether or not the forcible modulation is now being performed is determined. Specifically, whether or not the three-way catalytic converter 30 has reached a specific active state and the conditions for starting the forcible modulation control has been satisfied and therefore the forcible modulation control has been started is determined. If the result of the determination is No, namely it is determined that the forcible modulation is not being performed, the current execution of the routine ends. If the result of the determination is Yes, namely it is determined that the forcible modulation is being performed, step S12 is performed.

In step S12, the time for which the A/F ratio should be on the "rich" side ("rich" time) and the time for which the A/F ratio should be on the "lean" side ("lean" time) in the forcible modulation are set to a specific time t1 and a specific time t2, respectively, so that the period T of the modulation is set to a specific period T1.

Generally, the $O_2$ sensor 22 has a response delay. In the forcible modulation, the output of the $O_2$ sensor cannot keep up with a rapid change in the oxygen concentration and tends to indicate a value less than the actual value. This tendency is more prominent when the period of the forcible modulation is shorter, or in other words, the "rich" time and the "lean" time are shorter.

Here, in order to prevent the output of the $O_2$ sensor from plateauing even when the amplitude of the forcible modulation is increased to improve the exhaust purification performance, this response delay is utilized. Specifically, the output of the $O_2$ sensor is held down by appropriately limiting the "rich" time and the "lean" time depending on the amplitude of the forcible modulation ("rich" side amplitude, "lean" side amplitude) so that the exhaust A/F ratio to be detected on the basis of the output of the $O_2$ sensor will not reach the upper or lower limit (upper or lower boundary) of the A/F ratio detection range, or in other words, will be within the A/F ratio detection range, irrespective of the amplitude of the forcible modulation. In other words, the period T1 of the forcible modulation is set to be equal to or shorter than a maximum period (1.0 s, for example) which ensures that the exhaust A/F ratio to be detected on the basis of the $O_2$ sensor does not exceed the A/F ratio detection range.

The "lean" side amplitude and the "rich" side amplitude may be defined relative to either the stoichiometric A/F ratio or the middle value of the output of the $O_2$ sensor. The A/F ratio detection range is the range of A/F ratios detectable by the $O_2$ sensor in its steady state. This A/F ratio detection range is a steady range, for example between the rich side A/F ratio obtained from the output of the $O_2$ sensor 500 ms after the switch from the lean A/F ratio to the rich A/F ratio (upper limit) and the lean side A/F ratio obtained from the output of the $O_2$ sensor 500 ms after the switch from the rich A/F ratio to the lean A/F ratio (lower limit).

Figure 5:
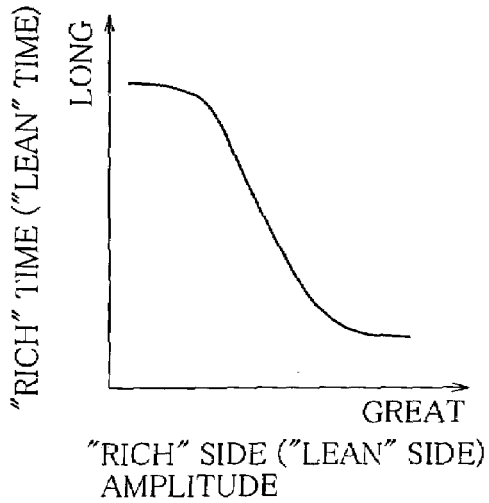
FIG. 5 is a map representing relation between "lean" side amplitude and "lean" time and between "rich" side amplitude and "rich" time.

Actually, the relation between the "lean" side amplitude and the "lean" time and the relation between the "rich" side amplitude and the "rich" time are determined in advance by experiment or the like, and stored in the ECU 40 as a map as shown in FIG. 5. The specific time t1 and the specific time t2 to which the "lean" time and the "rich" time should be set are read from the map depending on the "lean" side amplitude and the "rich" side amplitude. Specifically, when the "lean" side amplitude and the "rich" side amplitude are greater, the "lean" time and the "rich" time are limited to shorter times.

Basically, the output of the $O_2$ sensor is more likely to fail to keep up with a rapid change in $O_2$ concentration caused by the forcible modulation, when the response delay of the $O_2$ sensor 22 is greater (for example, the exhaust flow rate is smaller, the engine speed Ne is lower, the catalyzer temperature is lower, the exhaust temperature is lower, the volumetric efficiency is lower, the brake mean effective pressure is lower, the intake manifold pressure is lower, or the exhaust pressure is lower), or when the exhaust transport delay is greater (for example, the volume of the section of the exhaust system upstream of the $O_2$ sensor is greater, the exhaust flow rate is smaller, the engine speed Ne is lower, or the volumetric efficiency is lower), or when the active state of the $O_2$ sensor is worse (for example, the cooling water temperature is lower, the intake temperature is lower, the lubricating oil temperature is lower, the time which has passed after starting is shorter, the time for which the $O_2$ sensor heater has been supplied with a current is shorter, or the distance traveled is longer). Hence it is desirable to set the "lean" time and the "rich" time depending on at least one of these three factors: the $O_2$ sensor 22 response delay, the exhaust transport delay and the $O_2$ sensor active state. Specifically, the "lean" time and the "rich" time are set to be shorter when the $O_2$ sensor 22 response delay is smaller, or when the exhaust transport delay is smaller, or when the $O_2$ sensor active state is better. It is to be noted that as the distance traveled becomes longer, the $O_2$ sensor deteriorates and its active state becomes worse.

In addition, the "lean" time and the "rich" time are so set as to ensure that the output of the $O_2$ sensor 22 varies passing through a switch point (inflection point P in FIG. 2) of the output characteristic curve of the $O_2$ sensor 22. Thus, the period is set to a specific period T1. Specifically, if the period T1 of the forcible modulation is too short, the output of the $O_2$ sensor 22 can vary in a range not containing the switch point (inflection point) of the output characteristic curve of the $O_2$ sensor 22. Hence, the period T1 is here set to be equal to or longer than a minimum period (0.05 s, for example) which ensures that the output of the $O_2$ sensor 22 varies passing through the switch point.

Here, as an easy means, the "lean" time and the "rich" time may be fixed at the optimum values (0.4 s and 0.4 s, for example) predetermined depending on the catalytic system.

It is possible to ensure that the output of the $O_2$ sensor 22 varies passing through the switch point, by adjusting the amplitude or waveform of the modulation, instead of adjusting the period of the modulation as described above. Specifically, this can be ensured by increasing the amplitude of the modulation or making the waveform of the modulation closer to a square wave.

Although here, the "lean" time and the "rich" time are defined in terms of time, they may be defined in terms of cycle.

Figure 6:
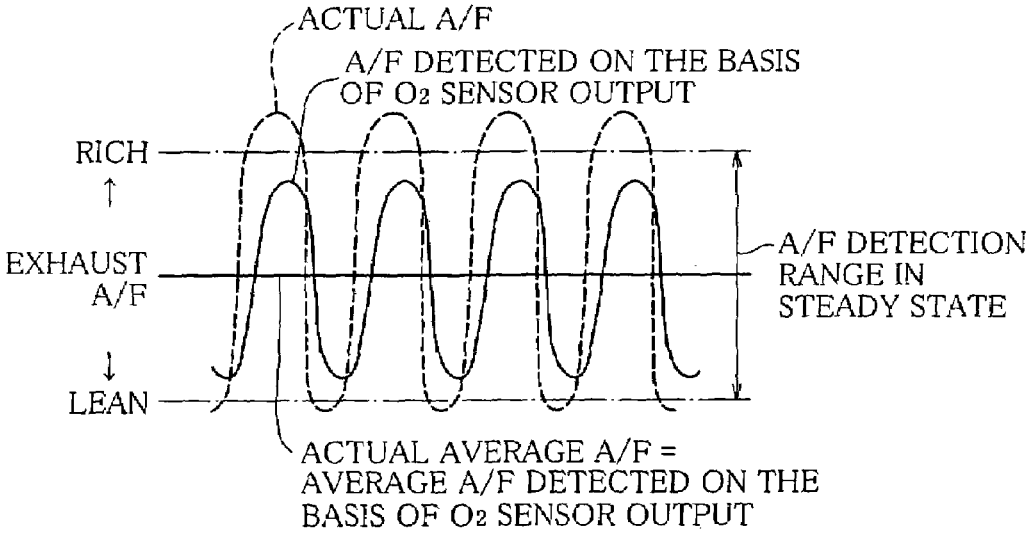
FIG. 6 shows the exhaust A/F ratio detected on the basis of the output of the $O_2$ sensor (solid curve), when "rich" time and "lean" time are limited in the forcible modulation feedback control, FIG. 7(*a*) shows a control waveform for controlling the exhaust A/F ratio in the forcible modulation feedback control, FIG. 7(*b*) shows the output waveform which the output of the $O_2$ sensor describes.

As shown in FIG. 6, when the "lean" time and the "rich" time are set to the specific time t1 and the specific time t2 in the above-described manner, so that the period is set to the specific period T1, the exhaust A/F ratio detected on the basis of the output of the $O_2$ sensor 22 (shown by the solid line) has its amplitude reduced so that it is properly within the A/F ratio detection range, although the actual amplitude of the exhaust A/F ratio forcibly modulated (shown by the solid line) remains unchanged.

In step S14, the ratio of the time tr for which the output of the $O_2$ sensor 22 is greater than a standard value Sb for the output set between the maximum and minimum values of the output, in the period (time) T1 (referred to simply as "time ratio") is calculated according to equation (1) below (time ratio calculating element).

$$\text{Time ratio}=(\text{time } tr \text{ for which the } O_2 \text{ sensor output is greater than the standard value } Sb)/\text{period } T1 \quad (1)$$

Figure 7:
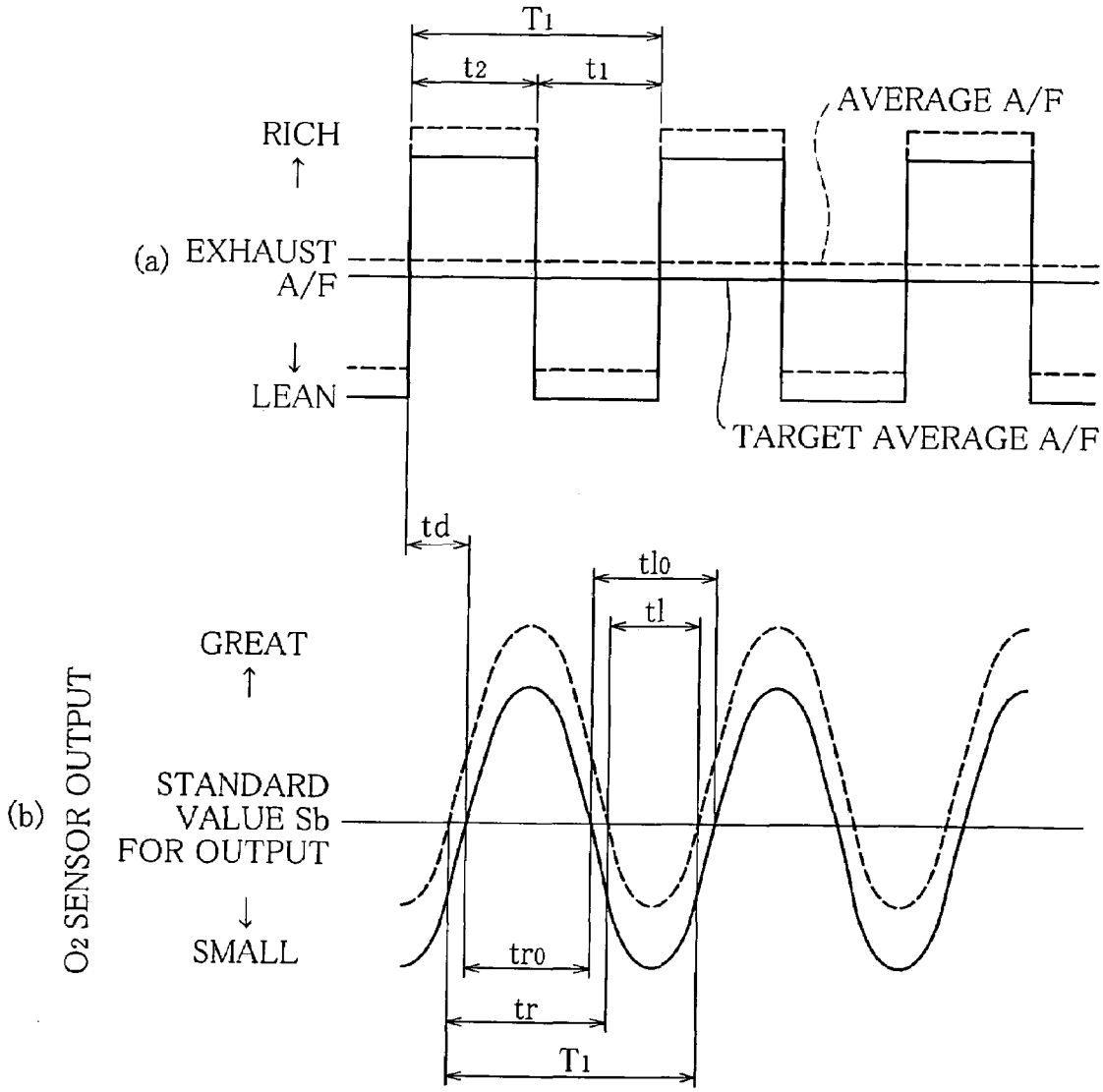

Specifically, FIG. 7 shows a control waveform (a) for controlling the exhaust A/F ratio in the forcible modulation control and the output waveform (b) which the output of the $O_2$ sensor 22 varying with a delay td describes. In this figure, a standard output waveform which the output of the $O_2$ sensor 22 describes when the average A/F ratio agrees with the target average A/F ratio is shown by the solid line, while an actual output waveform which the output of the $O_2$ sensor 22 describes when the average A/F ratio departs from the target average A/F ratio to the rich A/F ratio side is shown by the dashed line. Here, the ratio of the time tr for which the output of the $O_2$ sensor 22 is greater than the standard value Sb for the output in the period T1 is calculated as a time ratio.

When the average A/F ratio agrees with the target average A/F ratio, the ratio of the time tr0 for which the output of the $O_2$ sensor is greater than the standard value Sb for the output in the period T1 is calculated as a standard value Rb for the ratio.

Although the time ratio is obtained here as a ratio of the time tr, tr0 for which the output of the $O_2$ sensor 22 is greater than the standard value Sb for the output, the time ratio may be obtained as a ratio of the time t1, t10 for which the output of the $O_2$ sensor 22 is smaller than the standard value Sb for the output.

Here, the standard value Sb for the output is set to the value at the switch point (inflection point in FIG. 2) of the output characteristic curve of the $O_2$ sensor 22 (0.5 V, for example) or a value close to it, for example. The reason for setting the standard value Sb for the output to the value at the switch point or a value close to it is: although the output of the $O_2$ sensor 22 can vary due to aging or the like, the degree of such variation due to aging or the like is smallest in the vicinity of the switch point. Hence, the ratio of the time for which the output of the $O_2$ sensor 22 is greater (or smaller) than the standard value Sb for the output in the period T1 can be always obtained properly.

As mentioned above, the period T1 of the forcible modulation is so determined as to ensure that the output of the $O_2$ sensor 22 varies passing through the switch point. Hence, even when the standard value Sb for the output is set to the value at the switch point, for example, the ratio of the time for which the output of the $O_2$ sensor is greater (or smaller) than the standard value Sb for the output in the period T1 can be obtained with certainty.

Figure 8:
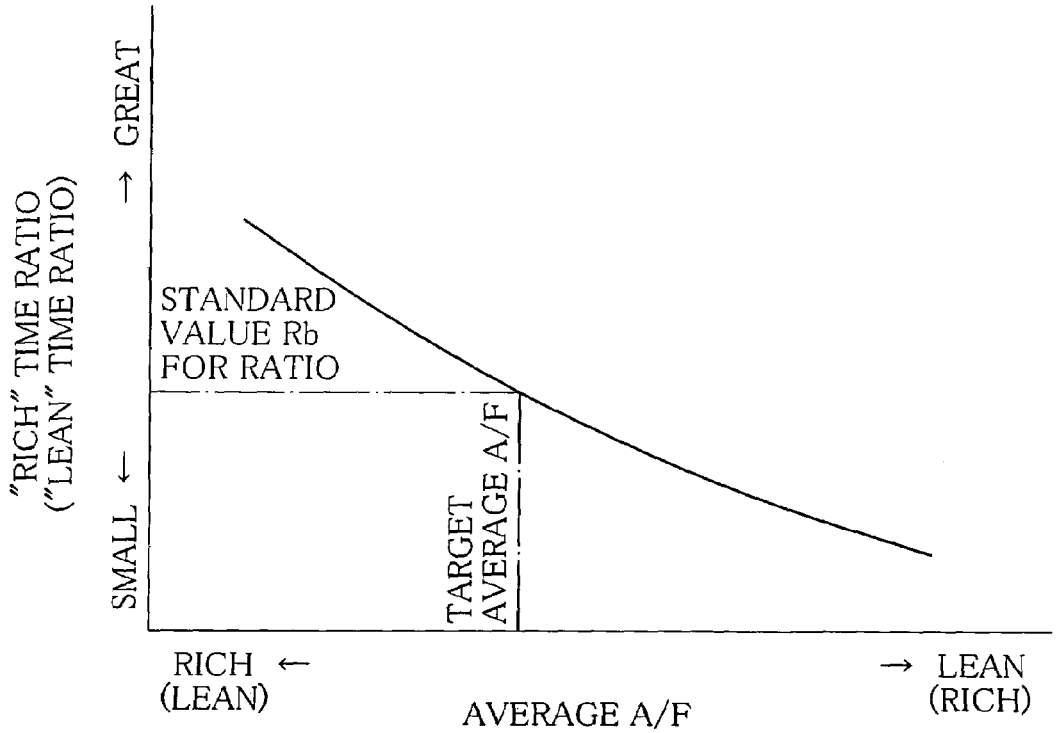
FIG. 8 is a time ratio map representing relation between time ratio and average exhaust A/F ratio.

After the time ratio is obtained as described above, the average exhaust A/F ratio is obtained from this time ratio in step S16. Specifically, as shown in FIG. 8, the relation between the time ratio and the average exhaust A/F ratio is determined in advance by experiment or the like and stored in the ECU 40 as a time ratio map. The average exhaust A/F ratio is read from this time ratio map.

Thus, even when the $O_2$ sensor, which is less expensive than the linear A/F ratio sensor (LAFS) and has a characteristic that the output varies non-linearly with respect to the A/F ratio, is used as an exhaust sensor, by utilizing the response relay of the $O_2$ sensor, the average exhaust A/F ratio can be detected properly on the basis of the time ratio.

In step S18, on the basis of the difference between the average exhaust A/F ratio thus obtained and the target average A/F ratio, namely the amount by which the former departs from the latter, the A/F ratio is adjusted so that the average A/F ratio agrees with the target average A/F ratio (air/fuel ratio adjusting element). In other words, feedback control is performed so that the average exhaust A/F ratio agrees with the target average A/F ratio. The feedback control may be either the PID control or the one based on the modern control theory.

Here, as the average A/F ratio, the average A/F ratio obtained in Step S16 may be used as it is. Alternatively, a value obtained by averaging average A/F ratios obtained over a specific period of time or a value smoothed by weighted average (filtering) may be used.

Although in the present instance, the time ratio is converted into the average A/F ratio, or generally the A/F ratio, it may be so arranged that the time ratio is converted into a value correlating with the A/F ratio (for example, fuel/air ratio, equivalent ratio, fuel injection quantity, fuel injection timing, or $O_2$ sensor output), and the value correlating with the A/F ratio is adjusted so that the average value of the value correlating with the A/F ratio agrees with a target for it.

By this, the average exhaust A/F ratio can be properly adjusted to the target average A/F ratio on the basis of the time ratio. Consequently, although the inexpensive $O_2$ sensor is used, the accuracy of the forcible modulation feedback control on the exhaust A/F ratio can be improved, therefore the forcible modulation of the exhaust A/F ratio can be always kept in a proper state, and therefore the exhaust purification performance of the three-way catalytic converter 30 can be improved.

Next, a second embodiment will be described.

Although in the above-described first embodiment, the time ratio is converted into the average A/F ratio and the average A/F ratio is adjusted to the target average A/F ratio, it can be so arranged that the time ratio is directly adjusted to the standard value Rb for the ratio which corresponds to the average A/F ratio (see FIG. 8). The second embodiment relates to an instance in which the time ratio is adjusted to the standard value Rb for the ratio.

Here, since the basic structure of the exhaust purification device is the same as that shown in FIG. 1, the description thereof will be omitted. Only those aspects of the forcible modulation feedback control in which the second embodiment is different from the first embodiment will be described.

Figure 9:
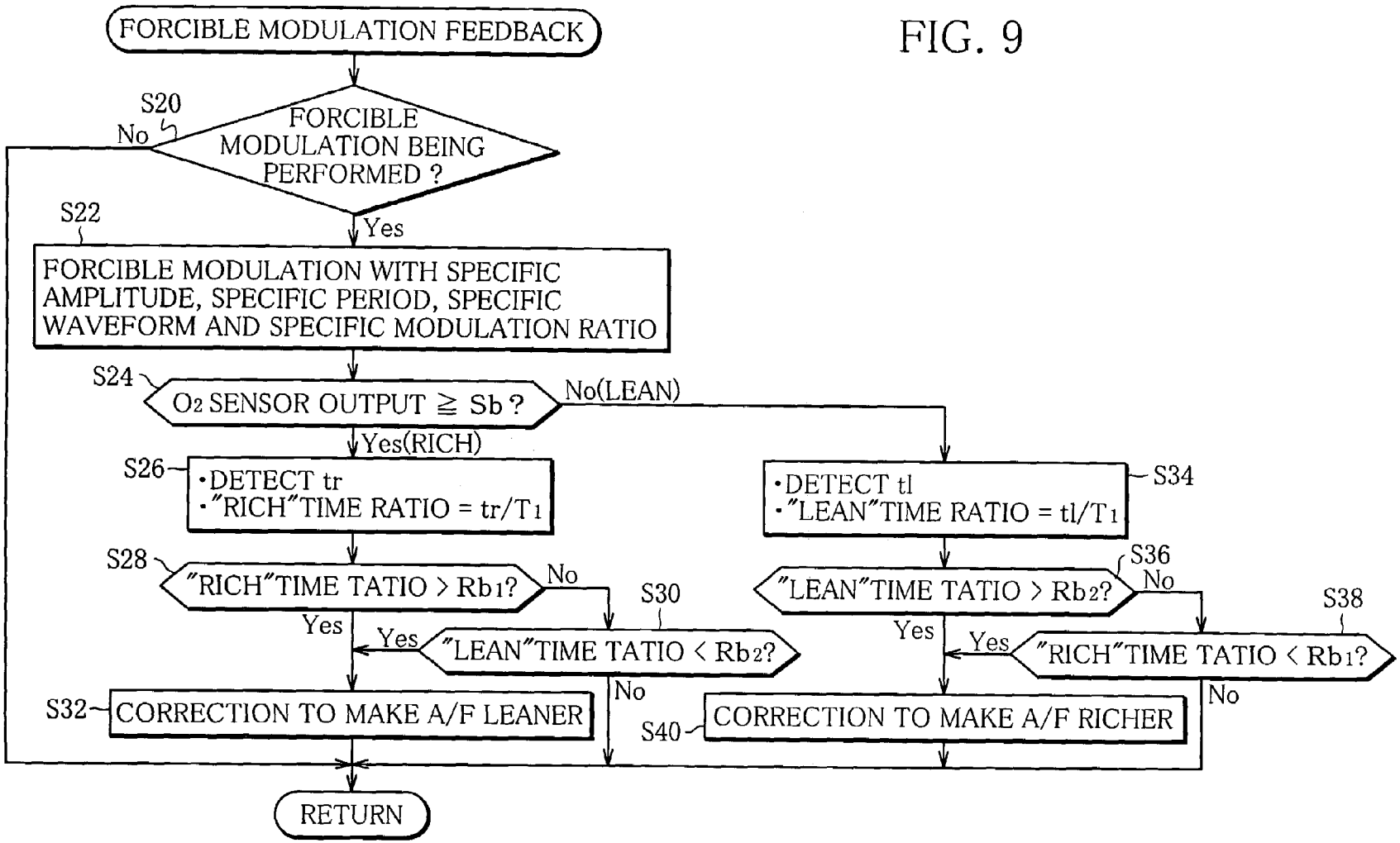
FIG. 9 is a flow chart showing a control routine for forcible modulation feedback control in a second embodiment of this invention.

FIG. 9 shows a control routine for forcible modulation feedback control in the second embodiment of the present invention, in the form of a flow chart. The description below will be given according to this flow chart.

In step S20, whether or not the forcible modulation is now being performed is determined in the same way as in step S10 mentioned above. If the result of the determination is No, namely it is determined that the forcible modulation is not being performed, the current execution of the routine ends. If the result of the determination is Yes, namely it is determined that the forcible modulation is being performed, step S22 is performed.

In step S22, the amplitude, period, waveform, and modulation ratio of the forcible modulation are set specifically.

The reason for setting the amplitude, period and waveform of the modulation is: it is known that the relation between the time ratio and the average exhaust A/F ratio (see FIG. 8) is actually affected by the operating states of the engine 1, namely the operating conditions such as the engine speed Ne and the exhaust flow rate, and the amplitude, period and waveform of the modulation based on the operating conditions. If the amplitude, period and waveform of the modulation are inappropriate, the average A/F ratio may depart from the true value. The reason for setting the modulation ratio is basically to perform the forcible modulation so that the average A/F ratio agrees with the target average A/F ratio.

Specifically, for example under the operating conditions such that the engine speed Ne is lower and the exhaust flow rate is smaller, the amplitude, period and waveform of the modulation are set to be greater, longer and closer to a square wave, respectively, so that the output of the $O_2$ sensor 22 can vary passing through the switch point of the output characteristic curve of the $O_2$ sensor 22 as mentioned above. The period is set to, for example the above-mentioned specific period T1 (0.05 s or longer, for example). The modulation ratio is set, for example such that the "lean" time and the "rich" time are a specific time t1 (0.4 s, for example) and a specific time t2 (0.4 s, for example), as mentioned above.

In step S24, whether or not the output of the $O_2$ sensor 22 is equal to or greater than the standard value Sb for the output is determined. Here, the standard value Sb for the output is set to, for example the value at the switch point of the output characteristic curve of the $O_2$ sensor (0.5V, for example), as in the first embodiment. If the result of the determination is Yes, namely it is determined that the output of the $O_2$ sensor 22 is equal to or greater than the standard value Sb for the output, or in other words, the exhaust A/F ratio is on the rich A/F ratio side, step S26 is performed.

In step S26, the "rich" duration tr, which means the time for which the exhaust A/F ratio is on the rich A/F ratio side, or in other words, the output of the $O_2$ sensor 22 is equal to or greater than the standard value Sb for the output ("rich" output time) is detected, and "rich" time ratio is calculated according to equation (2) below.

$$\text{"rich" time ratio} = \text{"rich" duration } tr/\text{period } T1 \quad (2)$$

Meanwhile, if the result of the determination in step S24 is No, namely it is determined that the output of the $O_2$ sensor 22 is smaller than the standard value Sb for the output, or in other words, the exhaust A/F ratio is on the lean A/F ratio side, step S34 is performed.

In step S34, the "lean" duration tl, which means the time for which the exhaust A/F ratio is on the lean A/F ratio side, or in other words, the output of the $O_2$ sensor 22 is smaller than the standard value Sb for the output ("lean" output time) is detected, and "lean" time ratio is calculated according to equation (3) below.

$$\text{"lean" time ratio} = \text{"lean" duration } tl/\text{period } T1 \quad (3)$$

In step S28, whether or not the "rich" time ratio calculated according to equation (2) is greater than a standard value Rb1 for the ratio is determined. Immediately after it is determined that the exhaust A/F ratio is on the rich A/F ratio side in step S24, the "rich" time ratio is smaller than the standard value Rb1 for the ratio. Hence, the result of the determination is No, so that the next step S30 is performed.

In step S30, whether or not the "lean" time ratio is smaller than a standard value Rb2 for the ratio. The "lean" time ratio here is the one obtained immediately before it is determined that the exhaust A/F ratio is on the rich A/F ratio side in step S24. If the result of the determination is No, namely it is determined that the "lean" time ratio is not smaller than the standard value Rb2 for the ratio, the current execution of the routine ends. If the result of the determination is Yes, namely it is determined that the "lean" time ratio is smaller than the standard value Rb2 for the ratio, step S32 is performed. It is to be noted that step S30 is performed only immediately after the result of the determination in step S24 is Yes, namely it is determined that the exhaust A/F ratio is on the rich A/F ratio side, or only in a specific period of time.

The routine is executed repeatedly. When the result of the determination in step S28 is Yes, namely it is determined that the "rich" time ratio is greater than the standard value Rb1 for the ratio, step S32 is performed.

The "rich" time ratio being greater than the standard value Rb1 for the ratio or the "lean" time ratio being smaller than the standard value Rb2 for the ratio means that the average exhaust A/F ratio departs from the target average A/F ratio to the rich A/F ratio side. Hence, in step S32, correction to make the exhaust A/F ratio leaner is made so that the "rich" time ratio will agree with the standard value Rb1 for the ratio. Specifically, feedback control on the A/F ratio is performed on the basis of the difference between the "rich" time ratio and the standard value Rb1 for the ratio (air/fuel ratio adjusting element).

Meanwhile, in step S36, whether or not the "lean" time ratio calculated according to equation (3) is greater than the standard value Rb2 for the ratio is determined. Immediately after it is determined that the exhaust A/F ratio is on the lean A/F ratio side in step S24, the "lean" time ratio is smaller than the standard value Rb2 for the ratio. Hence, the result of the determination is No, so that the next step S38 is performed.

In step S38, whether or not the "rich" time ratio is smaller than the standard value Rb1 for the ratio is determined. The "rich" time ratio here is the one obtained immediately before it is determined that the exhaust A/F ratio is on the lean A/F ratio side in step S24. If the result of the determination is No, namely it is determined that the "rich" time ratio is not smaller than the standard value Rb1 for the ratio, the current execution of the routine ends. If the result of the determination is Yes, namely it is determined that the "rich" time ratio is smaller than the standard value Rb1 for the ratio, step S40 is performed. It is to be noted that step S38 is performed only immediately after the result of the determination in step S24 is No, namely it is determined that the exhaust A/F ratio is on the lean A/F ratio side, or only in a specific period of time.

The routine is executed repeatedly. When the result of the determination in step S36 is Yes, namely it is determined that the "lean" time ratio is greater than the standard value Rb2 for the ratio, step S40 is performed.

The "lean" time ratio being greater than the standard value Rb2 for the ratio or the "rich" time ratio being smaller than the standard value Rb1 for the ratio means that the average exhaust A/F ratio departs from the target average A/F ratio to the lean A/F ratio side. Hence, in step S40, correction to make the exhaust A/F ratio richer is made so that the "lean" time ratio will agree with the standard value Rb2 for the ratio. Specifically, feedback control on the A/F ratio is performed on the basis of the difference between the "lean" time ratio and the standard value Rb2 for the ratio (air/fuel ratio adjusting element).

In the present instance, as the standard value Rb for the ratio which corresponds to the target average A/F ratio, the standard value Rb1 is used for the "rich" time ratio, while the standard value Rb2 is used for the "lean" time ratio. The reason for this is: when the target average A/F ratio is the stoichiometric A/F ratio, the standard value Rb1 agrees with the standard value Rb2 (Rb1=Rb2=0.5, for example); however, when the target average A/F ratio is not the stoichiometric A/F ratio, the standard value Rb1 does not agree with the standard value Rb2 (note that Rb1+Rb2=1.0).

A dead band may be provided near the standard value Rb1 and near the standard value Rb2, each.

It may be so arranged that (1−"lean" time ratio last time) is used in place of the standard value Rb1 and (1−"rich" time ratio last time) is used in place of the standard value Rb2. In this instance, feedback control on the A/F ratio in step S32 is performed on the basis of the difference between the "rich" time ratio and (1−"lean" time ratio last time), and feedback control on the A/F ratio in step S40 is performed on the basis of the difference between the "lean" time ratio and (1−"rich" time ratio last time).

By this, the average exhaust A/F ratio can be properly adjusted to the target average A/F ratio on the basis of the difference between the "rich" time ratio and the standard value Rb1 and the difference between the "lean" time ratio and the standard value Rb2. Consequently, as in the first embodiment, although the inexpensive $O_2$ sensor 22 is used, the accuracy of the forcible modulation feedback control on the exhaust A/F ratio can be improved, therefore the forcible modulation of the exhaust A/F ratio can be always kept in a proper state, and therefore the exhaust purification performance of the three-way catalytic converter 30 can be improved.

Next, a modified second embodiment will be described.

In the above-described second embodiment, it is assumed that the period of the modulation in the forcible modulation feedback control (the period of variation of the fuel quantity) is fixed. However, when the period of the modulation is changed depending on the operating conditions, etc., the period of variation (modulation) of the exhaust actually reaching the $O_2$ sensor 22 or detected by the $O_2$ sensor 22 can differ from the set period of the modulation, due to the delay of the exhaust system. In this instance, the time ratio ("rich" time ratio or "lean" time ratio) obtained differs from the true value, which leads to deterioration in the accuracy of the control.

Hence, in the modified second embodiment, when the period of the modulation is changed depending on the operating conditions of the engine 1, etc., the time ratio ("rich" time ratio or "lean" time ratio) is corrected. How to correct the time ratio when the period of the modulation is changed will be described below.

In a first technique, periods of the modulation set in the past (referred to "past periods") are stored, and the time ratio, for example the "rich" time ratio is calculated according to equation (2') below.

"rich" time ratio="rich" duration this time *tr*/specific past period *T*1' considered equivalent to period allowing for delay of exhaust system (2')

Specifically, in this technique, allowing for the delay of the exhaust system, a specific past period T1' stored is considered as the period corresponding to the "rich" duration this time tr, and the "rich" time ratio is obtained using this past period T1'. In this way, the changed period of the modulation can be corrected by an amount corresponding to the delay of the exhaust system. The "lean" time ratio can be calculated in the same way.

In a second technique, the period of variation (modulation) of the exhaust reaching the $O_2$ sensor 22 or detected by the $O_2$ sensor 22 is detected directly, and the time ratio, for example the "rich" time ratio is calculated according to equation (2") below.

"rich" time ratio="rich" duration this time *tr*/("lean" duration last time *tl*'+"rich" duration this time *tr*) (2")

Specifically, in this technique, the period corresponding to the "rich" duration this time tr is obtained as the sum of the "rich" duration this time tr and the "lean" duration last time tl', each detected by the $O_2$ sensor 22, and the "rich" time ratio is obtained using this sum. Also in this way, the changed period of the modulation can be corrected by an amount corresponding to the delay of the exhaust system. The "lean" time ratio can be calculated in the same way.

Next, a third embodiment will be described.

In the above-described first and second embodiments, the period of the modulation is set to a specific period T1 which ensures that the output of the $O_2$ sensor 22 varies passing through the switch point of the output characteristic curve of the $O_2$ sensor 22. However, the period which ensures that the output of the $O_2$ sensor 22 varies passing through the switch point can change. The third embodiment relates to an instance in which the period which ensures that the output of the $O_2$ sensor 22 varies passing through the switch point changes, so that correction to the period of the modulation is made. Here, an instance in which this correction to the period of the modulation is added to the second embodiment will be described.

Also in this instance, since the basic structure of the exhaust purification device is the same as that shown in FIG. 1, the description thereof will be omitted. Here, only the aspects in which the third embodiment is different from the second embodiment will be described.

Figure 10:
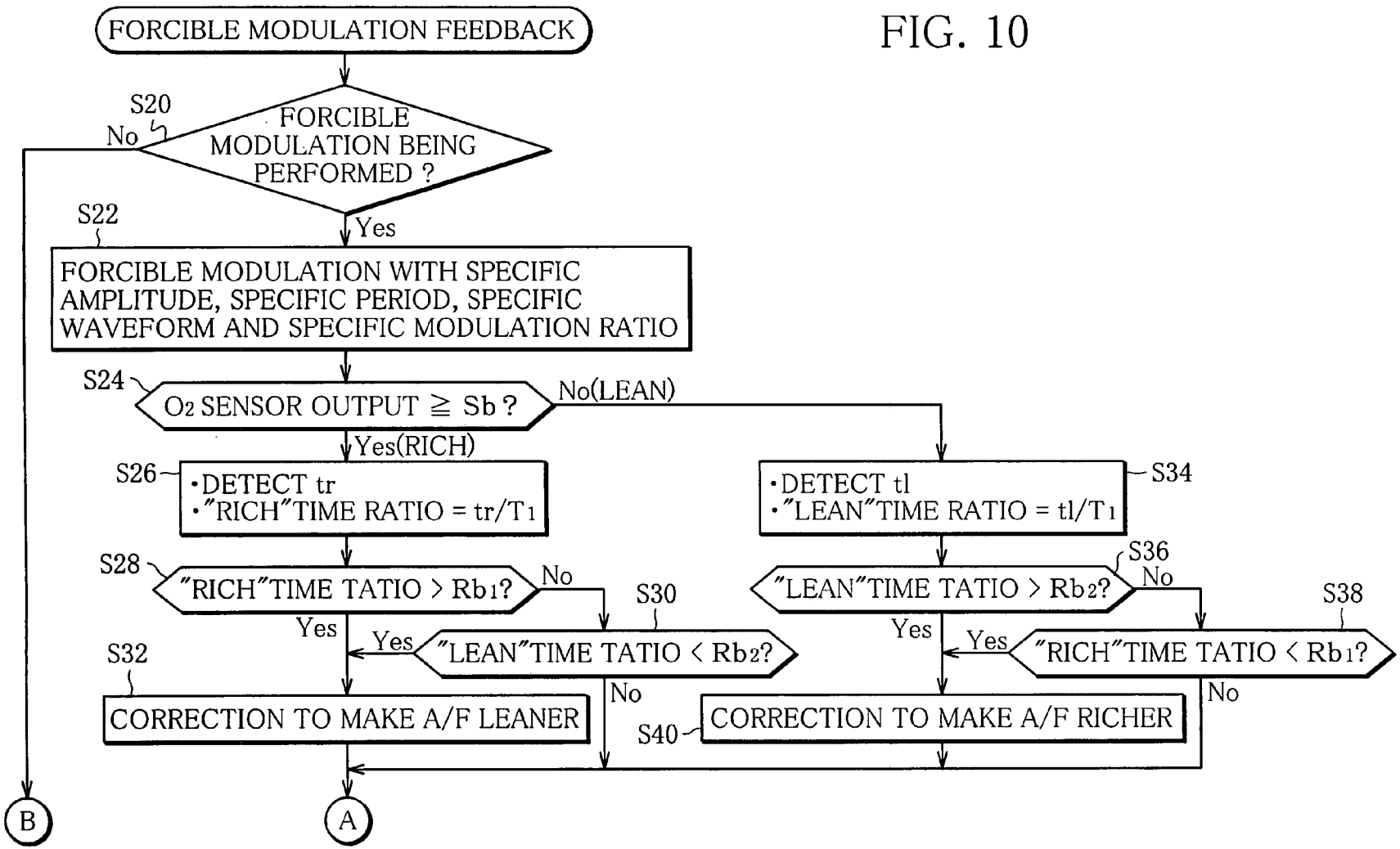
FIG. 10 is part of a flow chart showing a control routine for forcible modulation feedback control in a third embodiment of this invention.
Figure 11:
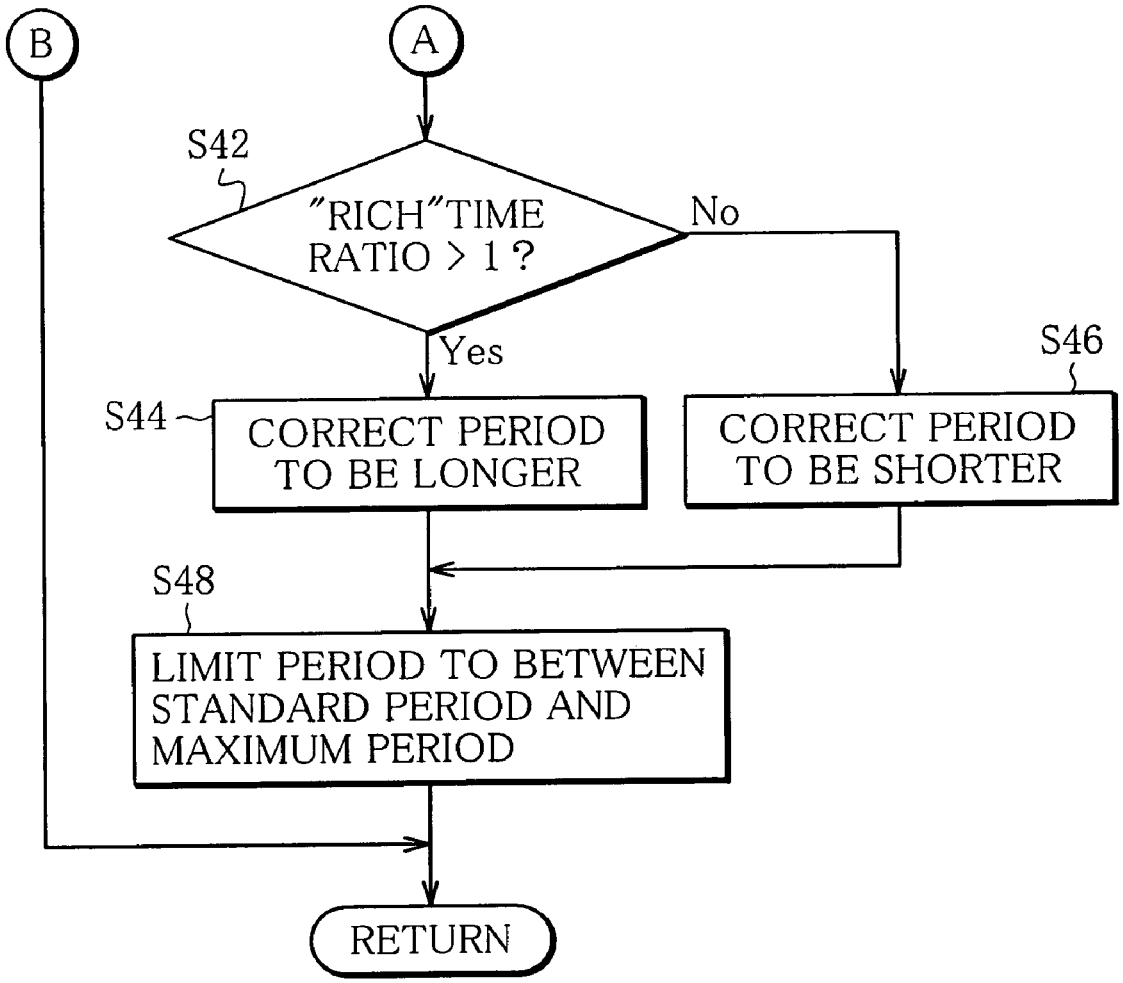
FIG. 11 is the remaining part of the flow chart showing the control routine for forcible modulation feedback control in the third embodiment of this invention, which follows FIG. 10.

FIGS. 10 to 11 show a control routine for forcible modulation feedback control in the third embodiment of the present invention, in the form of a flow chart. The description below will be given according to this flow chart. In this flow chart, the same steps as those in FIG. 9 are identified by the same numbers. The description of those steps will be omitted.

After steps S20 to S40, in step S42, whether or not the "rich" time ratio is greater than 1 is determined. The "rich" time ratio being greater than 1 means that that the output of the $O_2$ sensor 22 varies not passing through the switch point of the output characteristic curve of the $O_2$ sensor 22 and the exhaust A/F ratio is always on the rich A/F ratio side. Hence, here, whether or not the output of the $O_2$ sensor 22 is varying without passing through the switch point is determined. If the result of the determination is Yes, namely it is determined that the "rich" time ratio is greater than 1, step S44 is performed.

In step S44, the period of the modulation is corrected to be longer. In other words, the period of the modulation is corrected to be longer than the set period T1 so that the output of the $O_2$ sensor 22 can vary passing through the switch point.

Meanwhile, if the result of the determination in step S42 is No, namely it is determined that the "rich" time ratio is equal to or smaller than 1, step S46 is performed, namely the period of the modulation is corrected to be shorter. In other words, the period of the modulation is corrected to be shorter than the set period T1 so that the output of the $O_2$ sensor 22 can vary passing through the switch point.

In step S48, the period of the modulation thus corrected is limited to between a standard period and a maximum period. Here, the standard period means a period serving as a standard for the forcible modulation, for example the above-mentioned specific period T1. The maximum period is, for example the maximum period which ensures that the exhaust A/F ratio to be detected on the basis of the $O_2$ sensor does not exceed the A/F ratio detection range (1.0 s, for example).

By this, the period of the modulation is adjusted to ensure that the output of the $O_2$ sensor 22 varies passing through the switch point. Hence, when the standard value Sb for the output is set to the value at the switch point, the ratio of the time for which the output is greater (or smaller) than the standard value Sb can be obtained with certainty. Consequently, the average exhaust A/F ratio can be properly adjusted to the target average A/F ratio on the basis of the time ratio.

In the described instance, by adjusting the period of the modulation, it is ensured that the output of the $O_2$ sensor 22 varies passing through the switch point. However, as mentioned above, adjusting the amplitude or waveform of the modulation is also effective. However, increasing the amplitude of the modulation or making the waveform of the modulation closer to the square wave leads to deterioration in fuel economy and feeling about driving. Hence it is desirable to adjust the amplitude or waveform of the modulation only when the deterioration in fuel economy and feeling about driving is small.

Next, a fourth embodiment will be described.

As mentioned above, the relation between the time ratio and the average exhaust A/F ratio (see FIG. 8) is actually affected by the operating states of the engine 1, namely the operating conditions such as the engine speed Ne and the exhaust flow rate, and the amplitude, period and waveform of the modulation based on the operating conditions, and therefore, the average A/F ratio obtained on the basis of the time ratio can differ from the true value.

Figure 12:
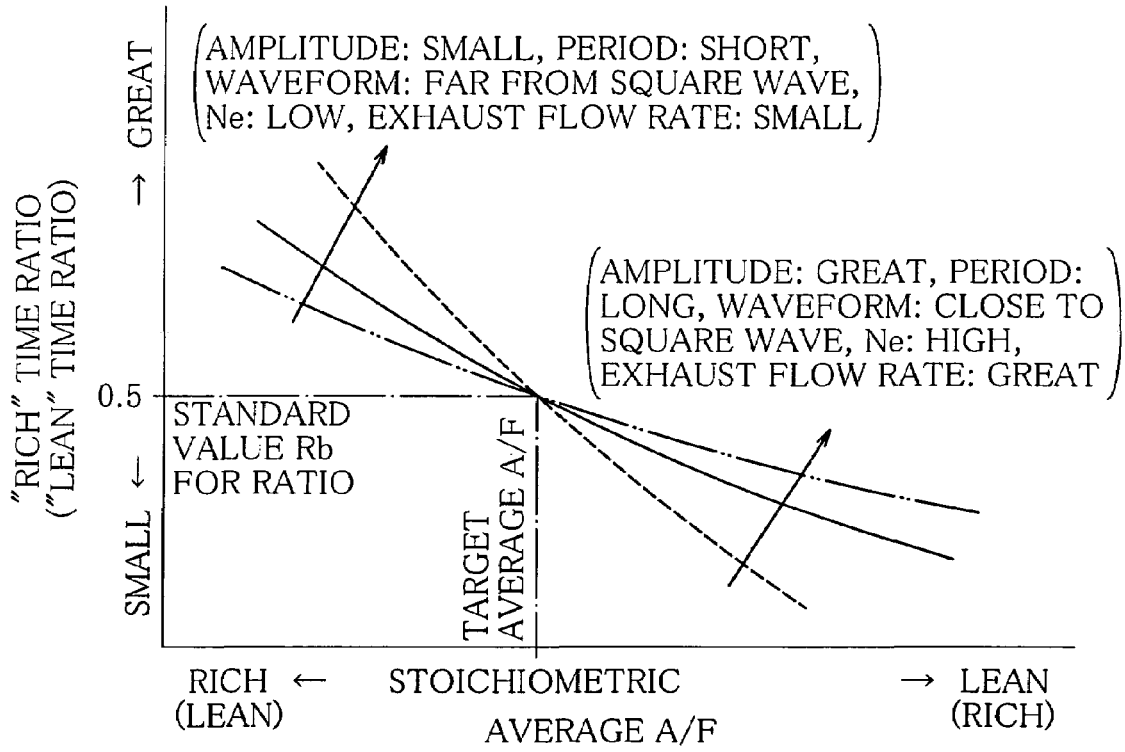
FIG. 12 shows how the relation between the time ratio and the average exhaust A/F ratio changes when the operating states of the engine such as engine speed Ne, exhaust flow rate, and the amplitude, period and waveform of the modulation change.

FIG. 12 schematically shows how the relation between the time ratio and the average exhaust A/F ratio changes when the operating states of the engine 1 such as the engine speed Ne, the exhaust flow rate, and the amplitude, period and waveform of the modulation change. As the figure shows, when the engine speed Ne becomes lower, the exhaust flow rate becomes smaller, the amplitude of the modulation becomes smaller, the period thereof becomes shorter, and the waveform thereof becomes farther from the square wave, the relation between the time ratio and the average exhaust A/F ratio tends to describe a curve like the dashed curve, with the standard value Rb for the output (0.5), namely the stoichiometric A/F ratio at the center. When the engine speed Ne becomes higher, the exhaust flow rate becomes greater, the amplitude of the modulation becomes greater, the period thereof becomes longer, and the waveform thereof becomes closer to the square wave, the relation between the time ratio and the average exhaust A/F ratio tends to describe a curve like the chain double-dashed curve, with the standard value Rb for the output (0.5), namely the stoichiometric A/F ratio at the center.

The fourth embodiment relates to an instance in which, in order to prevent the average A/F ratio obtained on the basis of the time ratio from departing from the true value, correction to the relation between the time ratio and the average exhaust A/F ratio depending on the operating states of the engine 1 such as the engine speed Ne, the exhaust flow rate and the amplitude, period and waveform of the modulation is added to the first embodiment. Here, an instance in which the correction to the relation between the time ratio and the average exhaust A/F ratio is made depending on the engine speed Ne will be described.

Also in this instance, since the basic structure of the exhaust purification device is the same as that shown in FIG. 1, the description thereof will be omitted. Here, only the aspects in which the fourth embodiment is different from the first embodiment will be described.

Figure 13:
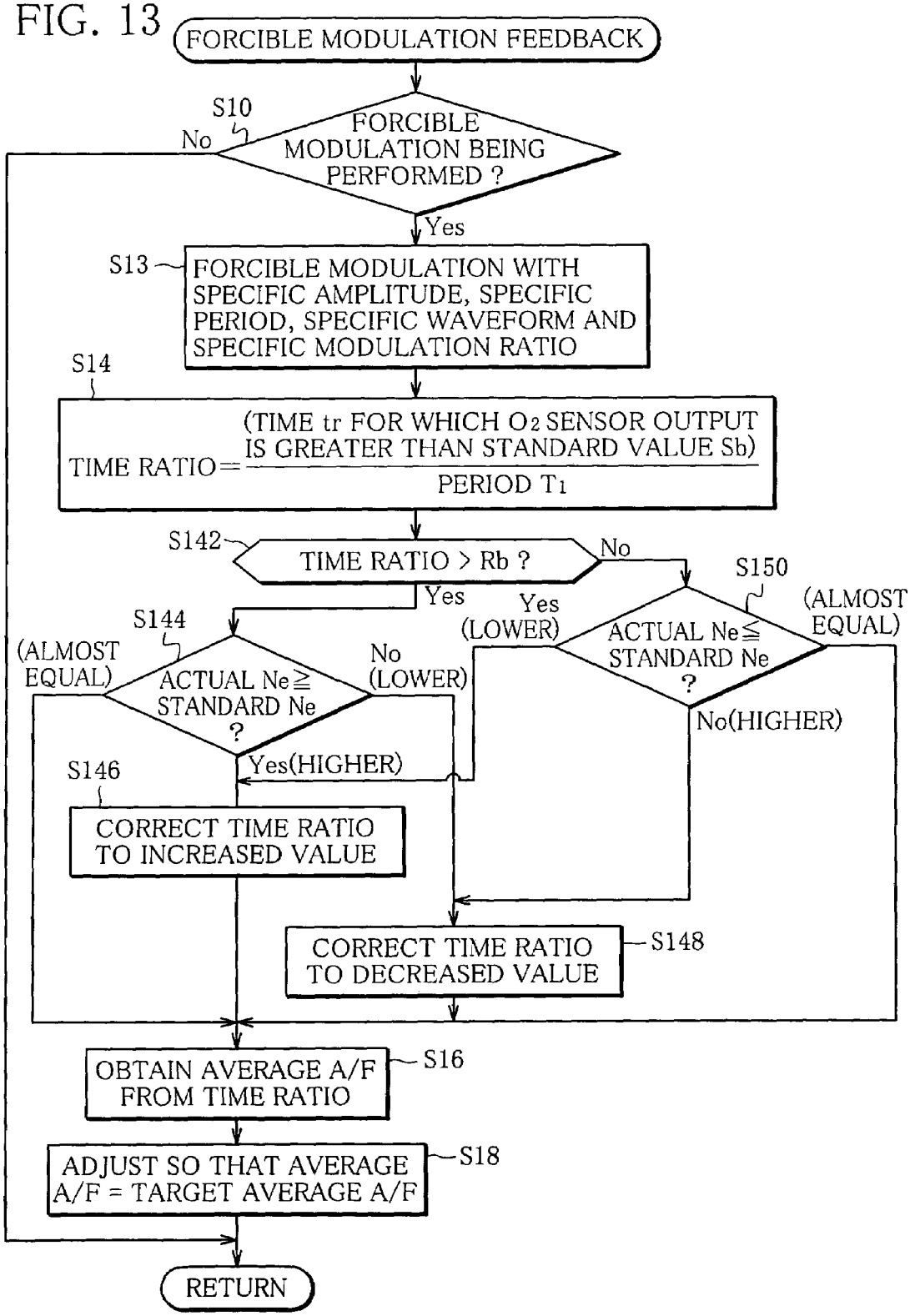
FIG. 13 is a flow chart showing a control routine for forcible modulation feedback control in a fourth embodiment of this invention.

FIG. 13 shows a control routine for forcible modulation feedback control in the fourth embodiment of the present invention, in the form of a flow chart. The description below will be given according to this flow chart. In this flow chart, the same steps as those in FIG. 4 are identified by the same numbers. The description of those steps will be omitted.

After step S10, in step S13, the amplitude, period, waveform and modulation ratio of the forcible modulation are set specifically. In step S14, the time ratio is obtained, and then in step S142, whether or not the time ratio is greater than the standard value Rb for the time ratio. If the result of the determination is Yes, namely it is determined that the time ratio is greater than the standard value Rb for the ratio, step S144 is performed.

In step S144, whether or not the engine speed Ne actually detected (referred to as "actual engine speed Ne") when the time ratio is greater than the standard value Rb for the ratio is equal to or greater than a standard engine speed is determined. Here, the standard engine speed Ne is, for example a low engine speed on the basis of which the amplitude, period and waveform of the modulation have been set in step S13. When it is determined that the actual engine speed Ne is almost equal to the standard engine speed Ne, step S16 is performed. When the result of the determination is Yes, namely it is determined that the actual engine speed Ne is higher than the standard engine speed Ne, step S146 is performed, and when the result of the determination is No, namely it is determined that the actual engine speed Ne is lower than the standard engine speed Ne, step S148 is performed.

In step S146, a value correlating with the time ratio is obtained by correcting the time ratio calculated according to equation (1) to an increased value. In step S148, a value correlating with the time ratio is obtained by correcting the time ratio to a decreased value. Specifically, the time ratio is corrected by a greater amount, when the time ratio is greater or smaller than the standard value Rb by a greater amount and when the difference between the actual engine speed Ne and the standard engine speed Ne is greater.

Meanwhile, if the result of the determination in step S142 is No, namely it is determined that the time ratio is equal to or smaller than the standard value Rb for the ratio, step S150 is performed.

In step S150, whether or not the actual engine speed Ne detected when the time ratio is equal to or smaller than the standard value Rb for the ratio is equal to or lower than the standard engine speed Ne is determined. When it is determined that the actual engine speed Ne is almost equal to the standard engine speed Ne, step S16 is performed. When the result of the determination is Yes, namely it is determined that the actual engine speed Ne is lower than the standard engine speed Ne, step S146 is performed, namely a value correlating with the time ratio is obtained by correcting the time ratio to an increased value. When the result of the determination is No, namely it is determined that the actual engine speed Ne is higher than the standard engine speed Ne, step S148 is performed, namely a value correlating with the time ratio is obtained by correcting the time ratio to a decreased value.

It may be so arranged that for the determination in steps S144 and S150, a dead band is provided near the standard engine speed Ne.

The above-described is an instance in which correction to the relation between the time ratio and the average A/F ratio is made depending on the engine speed Ne. In an instance in which the exhaust flow rate and the amplitude, period and waveform of the modulation change, when the time ratio is greater than the standard value Rb for the ratio, the time ratio is corrected to a more increased value when the exhaust flow rate is greater, the amplitude of the modulation is greater, the period thereof is longer and the waveform thereof is closer to the square wave, and corrected to a more decreased value when the exhaust flow rate is smaller, the amplitude of the modulation is smaller, the period thereof is shorter and the waveform thereof is further from the square wave. Meanwhile, when the time ratio is equal to or smaller than the standard value Rb for the ratio, the time ratio is corrected to a more decreased value when the exhaust flow rate is greater, the amplitude of the modulation is greater, the period thereof is longer and the waveform thereof is closer to the square wave, and corrected to a more increased value when the exhaust flow rate is smaller, the amplitude of the modulation is smaller, the period thereof is shorter and the waveform thereof is further from the square wave.

By correcting the time ratio this way, even when the relation between the time ratio and the average A/F ratio tends to describe a curve like the dashed curve or the chain double-dashed curve in FIG. 12, an appropriate average A/F ratio not departing from the true value can be obtained on the basis of the time ratio, like when the actual engine speed agrees with the standard engine speed Ne (in which instance, the relation between the time ratio and the average A/F ratio describes the solid curve).

In this instance, on the basis of the value correlating with the time ratio, the average exhaust A/F ratio can be more properly adjusted to the target average A/F ratio. Consequently, although the inexpensive $O_2$ sensor 22 is used, the accuracy of the forcible modulation feedback control on the exhaust A/F ratio can be further improved, therefore the forcible modulation of the exhaust A/F ratio can be always kept in a proper state, and therefore the exhaust purification performance of the three-way catalytic converter 30 can be improved.

In the described instance, correction is made to the time ratio. However, it is also possible to correct the average A/F ratio and perform control so that the corrected average A/F ratio will agree with the target average A/F ratio. Alternatively, correction may be made to the amount of control on the A/F ratio.

From FIG. 12, it is understood that when the standard value Rb for the ratio is close to 0.5, namely close to the value corresponding to the stoichiometric A/F ratio, the influence of the operating states of the engine 1 such as the engine speed Ne, the exhaust flow rate, and the amplitude, period and waveform of the modulation on the relation between the time ratio and the average exhaust A/F ratio is small. Hence, when the standard value Rb for the ratio is set to a value close to 0.5, namely the target average A/F ratio is set to a value close to the stoichiometric A/F ratio, the time ratio is necessarily adjusted to the standard value Rb for the ratio (value close to 0.5) when the average A/F ratio is adjusted to the target average A/F ratio. In this case, it can be said that the relation between the time ratio and the average exhaust A/F ratio is not easily affected by the operating states of the engine 1 such as the engine speed Ne, the exhaust flow rate, and the amplitude, period and waveform of modulation.

In other words, when the target average A/F ratio is set to a value close to the stoichiometric A/F ratio so that the standard value Rb for the ratio is close to 0.5, even when the average A/F ratio departs from the target average A/F ratio, it is possible to adjust the average A/F ratio to the target average A/F ratio, minimizing the influence of the operating states of the engine 1 such as the engine speed Ne, the exhaust flow rate, and the amplitude, period and waveform of the modulation, regardless of whether or not the time ratio is corrected.

Next, a fifth embodiment will be described.

The fifth embodiment relates to an instance in which, in order to prevent the average A/F ratio from departing from the true value, correction to the relation between the time ratio and the average exhaust A/F ratio depending on the operating states of the engine 1 such as the engine speed Ne, the exhaust flow rate, and the amplitude, period and waveform of the modulation is added to the second embodiment in which the time ratio is adjusted to the standard value Rb for the time ratio.

Also here, since the basic structure of the exhaust purification device is the same as shown in FIG. 1, the description thereof will be omitted. Only the aspects in which the fifth embodiment is different from the second embodiment will be described.

Figure 14:
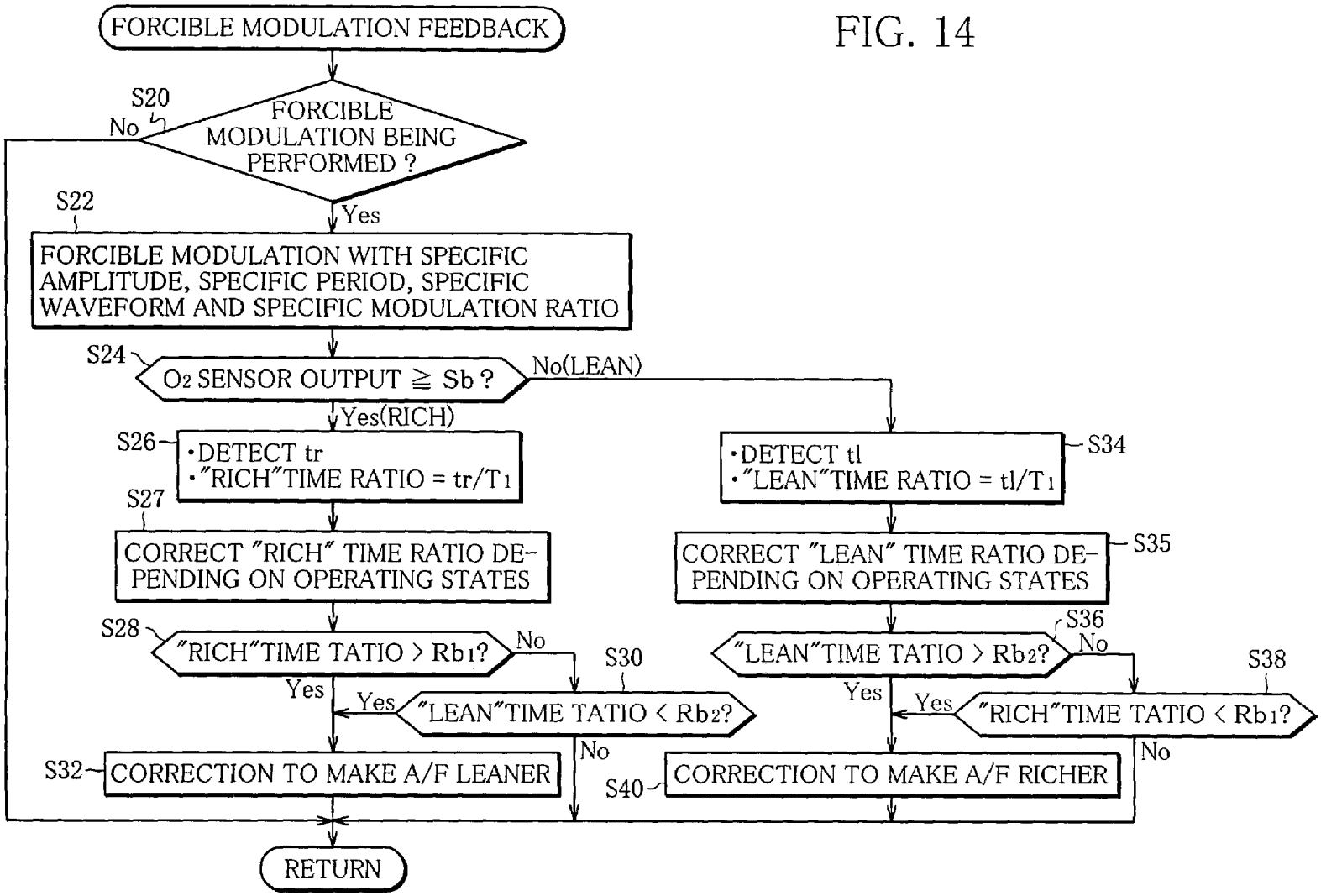
FIG. 14 is a flow chart showing a control routine for forcible modulation feedback control in a fifth embodiment of this invention.

FIG. 14 shows a control routine for forcible modulation feedback control in the fifth embodiment of the present invention, in the form of a flow chart. The description below will be given according to this flow chart. In this flow chart, the same steps as those in FIG. 9 are identified by the same numbers. The description of those steps will be omitted.

When the "rich" time ratio is obtained through steps S20 to S26, a value correlating with the "rich" time ratio is obtained in step S27 by correcting the "rich" time ratio depending on the operating states of the engine 1.

Specifically, like in the above-described embodiment, when the engine speed Ne, the exhaust flow rate, and the amplitude, period and waveform of the modulation change, when the "rich" time ratio is greater than the standard value Rb1 for the ratio, the "rich" time ratio is corrected to a more increased value when the engine speed Ne is higher, the exhaust flow rate is greater, the amplitude of the modulation is greater, the period thereof is longer and the waveform thereof is closer to the square wave, and corrected to a more decreased value when the engine speed Ne is lower, the exhaust flow rate is smaller, the amplitude of the modulation is smaller, the period thereof is shorter and the waveform thereof is further from the square wave. When the "rich" time ratio is smaller than the standard value Rb1 for the ratio, the "rich" time ratio is corrected to a more decreased value when the engine speed Ne is higher, the exhaust flow rate is greater, the amplitude of the modulation is greater, the period thereof is longer and the waveform thereof is closer to the square wave, and corrected to a more increased value when the engine speed Ne is lower, the exhaust flow rate is smaller, the amplitude of the modulation is smaller, the period thereof is shorter and the waveform thereof is further from the square wave. Then, step S28 and succeeding steps are performed.

Meanwhile, when the "lean" time ratio is obtained through steps S20 to S34, a value correlating with the "lean" time ratio is obtained in step S35 by correcting the "lean" time ratio depending on the operating states of the engine 1.

Specifically, like the above, when the engine speed Ne, the exhaust flow rate, and the amplitude, period and waveform of the modulation change, when the "lean" time ratio is greater than the standard value Rb2 for the ratio, the "lean" time ratio is corrected to a more increased value when the engine speed Ne is higher, the exhaust flow rate is greater, the amplitude of the modulation is greater, the period thereof is longer and the waveform thereof is closer to the square wave, and corrected to a more decreased value when the engine speed Ne is lower, the exhaust flow rate is smaller, the amplitude of the modulation is smaller, the period thereof is shorter and the waveform thereof is further from the square wave. When the "lean" time ratio is smaller than the standard value Rb2 for the ratio, the "lean" time ratio is corrected to a more decreased value when the engine speed Ne is higher, the exhaust flow rate is greater, the amplitude of the modulation is greater, the period thereof is longer and the waveform thereof is closer to the square wave, and corrected to a more increased value when the engine speed Ne is lower, the exhaust flow rate is smaller, the amplitude of the modulation is smaller, the period thereof is shorter and the waveform thereof is further from the square wave. Then, step S36 and succeeding steps are performed.

Figure 15:
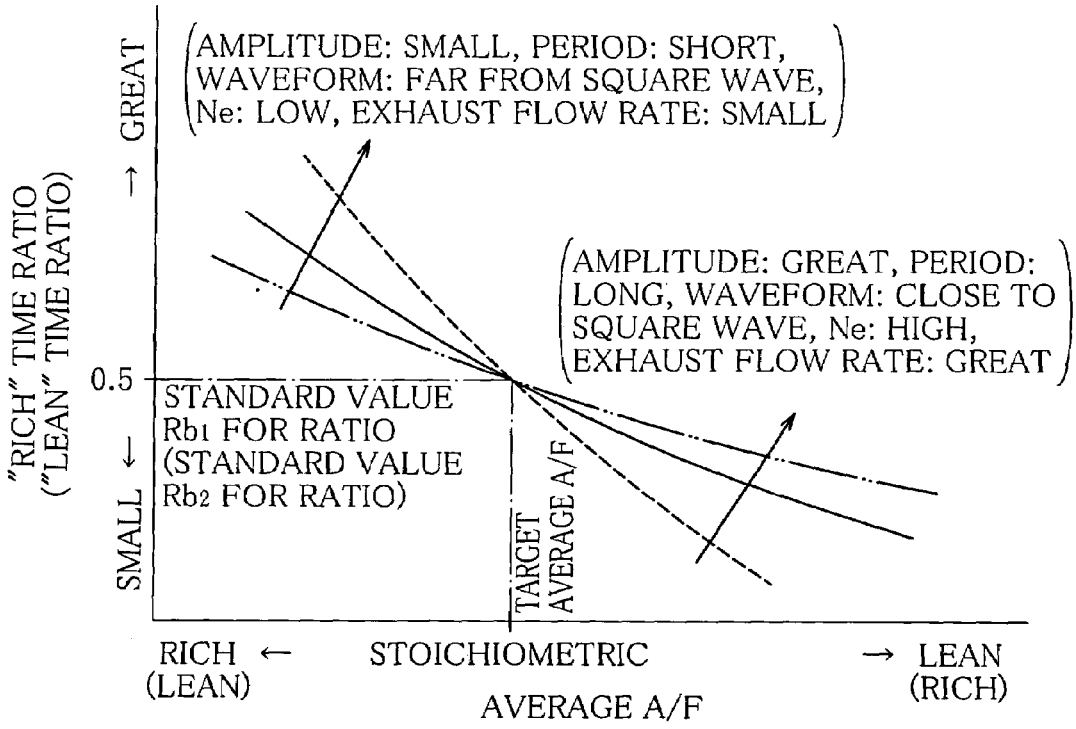
FIG. 15 shows how the relation between the "rich" time ratio or "lean" time ratio and the average exhaust A/F ratio changes when the operating states of the engine such as engine speed Ne, exhaust flow rate, and the amplitude, period and waveform of the modulation change.

By correcting the "rich" time ratio and the "lean" time ratio this way, even when the relation between the "rich" time ratio or the "lean" time ratio and the average A/F ratio tends to describe a curve like the dashed curve or the chain double-dashed curve in FIG. 15, an appropriate average A/F ratio not departing from the true value can be obtained on the basis of the "rich" time ratio or the "lean" time ratio, like when the actual engine speed, the actual exhaust quantity, and the actual amplitude, period, and waveform of the modulation agree with the standard engine speed Ne, the standard flow rate, the standard amplitude, period and waveform of the modulation (in which instance, the relation between the "rich" time ratio or the "lean" time ratio and the average A/F ratio describes the solid curve). Here, the standard amplitude, period and waveform of the modulation are, for example the specific amplitude, period T1 and waveform to which the amplitude, period and waveform of the modulation have been set in step S22. The standard engine speed Ne and the standard flow rate are a low engine speed Ne and a small exhaust quantity on the basis of which the amplitude, period and waveform of the modulation have been set to the specific amplitude, period T1 and waveform.

In this instance, on the basis of the difference between the value correlating with the "rich" time ratio and the standard value Rb1 for the ratio and the difference between the value correlating with the "lean" time ratio and the standard value Rb2 for the ratio, the average exhaust A/F ratio can be more properly adjusted to the target average A/F ratio. Consequently, although the inexpensive $O_2$ sensor 22 is used, the accuracy of the forcible modulation feedback control on the exhaust A/F ratio can be further improved, therefore the forcible modulation of the exhaust A/F ratio can be always kept in a proper state, and therefore the exhaust purification performance of the three-way catalytic converter 30 can be improved.

The above-described instance is one in which correction to the relation between the time ratio and the average A/F ratio depending on the operating states of the engine 1 such as the engine speed Ne, the exhaust flow rate, and the amplitude, period and waveform of the modulation is added to the second embodiment. This correction can be applied to the modified second embodiment or the third embodiment in a similar way.

Also in this instance, when the target average A/F ratio is set to a ratio close to the stoichiometric A/F ratio so that the standard values Rb1 and Rb2 for the ratio are close to 0.5 (note that Rb1+Rb2=1.0), even when the average A/F ratio departs from the target average A/F ratio, it is possible to adjust the average A/F ratio to the target average A/F ratio, minimizing the influence of the operating states of the engine 1 such as the engine speed Ne, the exhaust flow rate, and the amplitude, period and waveform of the modulation, regardless of whether or not the "rich" time ratio and the "lean" time ratio are corrected.

Next, a sixth embodiment will be described.

The sixth embodiment relates to an instance in which an $O_2$ sensor 220 provided with a catalyst is used in place of the $O_2$ sensor 22 in the first to fifth embodiments.

Figure 16:
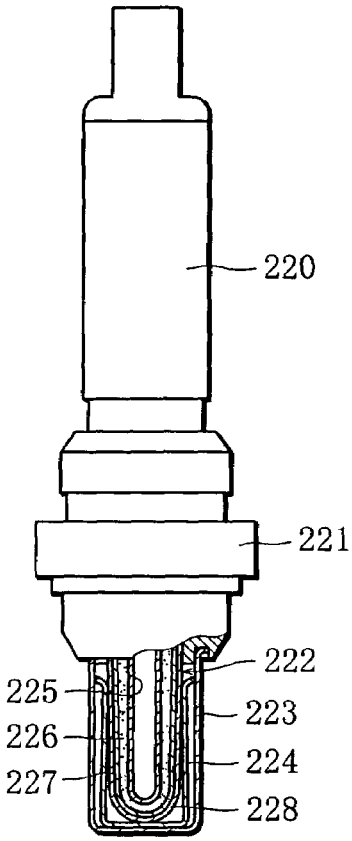
FIG. 16 shows an $O_2$ sensor provided with a catalyst.

As shown in FIG. 16, the $O_2$ sensor 220 with a catalyst includes a cup-shaped detecting component 222 attached to the interior of a housing 221, and a component cover 223 attached to surround the detecting component 222. The detecting component 222 has an inner electrode (atmosphere-side Pt electrode) 225 and an outer electrode (exhaust-side electrode) 226 arranged inside and outside a zirconia solid electrolyte 224, respectively. Outside the outer electrode 226 is provided an electrode protecting layer (ceramic coating or the like) 227. Further, outside the electrode protecting layer 227 is provided a catalytic layer 228 having a function of reducing $NO_x$.

When atmosphere having a high oxygen concentration is introduced to the inner electrode 225 and exhaust having a low oxygen concentration is introduced to the catalytic layer 228, an electromotive force is produced by the zirconia solid electrolyte 224 according to the difference in oxygen concentration between the inside and the outside. On the basis of this electromotive force, the oxygen concentration is detected, wherein $NO_x$ contained in the exhaust is reduced with the help of the catalytic layer 28, so that the oxygen concentration of the exhaust can be detected properly, including the oxygen contained in $NO_x$.

Figure 17:
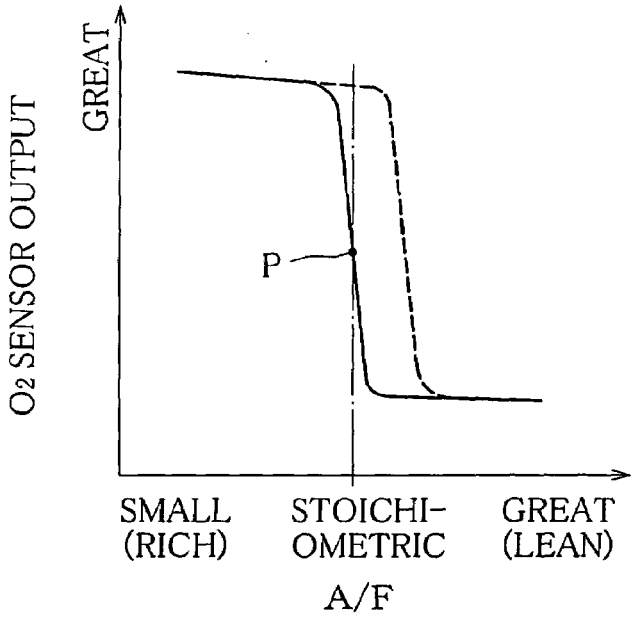
FIG. 17 shows the output characteristic curve of an $O_2$ sensor without a catalyst layer (dashed curve) and the output characteristic curve of an $O_2$ sensor provided without a catalyst (solid curve).

As shown in FIG. 17, the output characteristic curve of the $O_2$ sensor 22 without a catalytic layer (dashed curve) tends to be located to the lean A/F ratio side, as a whole. Meanwhile, the output characteristic curve of the $O_2$ sensor 220 with a catalyst (solid curve) is not located to one side, so that the switch point of the output characteristic curve is located at the stoichiometric A/F ratio as desired, so that the exhaust A/F ratio can be detected accurately.

Specifically, when the $O_2$ sensor without a catalytic layer is used and the standard value Sb for the output is set to, for example the value at the switch point (0.5 V), the actual switch point is located to the lean A/F ratio side, which causes a departure of the calculated value of the time ratio ("rich" time ratio, "lean" time ratio) from the true value of the time ratio. Hence, even when the average A/F ratio is adjusted to the target average A/F ratio on the basis of the calculated value of the time ratio ("rich" time ratio, "lean" time ratio), the average A/F ratio can be actually leaner than the target average A/F ratio. Meanwhile, the use of the $O_2$ sensor 220 with a catalyst makes it possible to obtain the time ratio ("rich" time ratio, "lean" time ratio) accurately and adjust the average A/F ratio to the target average, without a departure, with certainty.

Thus, as mentioned above, when the target average A/F ratio is set to be a value close to the stoichiometric A/F ratio so that the standard value Rb or the standard values Rb1 and Rb2 for the ratio are close to 0.5, it is possible to adjust the average exhaust A/F ratio to the target average A/F ratio, minimizing the influence of the operating states of the engine 1 such as the engine speed Ne, the exhaust flow rate, and the amplitude, period and waveform of the modulation, and that very accurately.

Hence, for example when the target average A/F ratio is set to a slightly rich A/F ratio close to the stoichiometric A/F ratio so that standard value Rb for ratio is within the range of 0.5 to 0.75 (range close to 0.5), or the standard values Rb1 and Rb2 for the ratio are within the range of 0.5 to 0.75 (range close to 0.5) and within the range of 0.25 to 0.5 (range close to 0.5), respectively, the average exhaust A/F ratio can be adjusted to the slightly rich A/F ratio accurately, with certainty. Consequently, in the three-way catalytic converter 30, the capacity to convert $NO_x$ can be improved with certainty while the capacity to convert HO and CO is ensured.

In the described instance, the catalytic layer 228 is one having a function of reducing $NO_x$. In addition to the catalytic layer 228, a catalytic layer having a function of oxidizing $H_2$ may be further provided, since the exhaust also contains $H_2$ which diffuses at a high speed and tends to cause the switch point of the output characteristic curve to be located to the lean A/F ratio side. Alternatively, the pores in a diffusion layer of the sensor may be increased.

Further, in the described instance, the $O_2$ sensor is provided with the catalytic layer 228 having a function of reducing $NO_x$. Alternatively, the outer electrode 226 may be provided as an $NO_x$-reducing electrode (Rh electrode or Pd electrode, for example).

Several embodiments of the present invention have been described so far. However, the present invention is not limited to those embodiments.

For example, in the described embodiments, the standard value Sb for the output is set as a fixed value. However, it may be so arranged that the standard value Sb for the output is read from a standard value map which represents how the standard value Sb for the output varies with respect to at least one of the factors: the response delay of the $O_2$ sensor 22 or the $O_2$ sensor 220 with a catalyst (which is greater, for example when the exhaust flow rate is smaller, the engine speed Ne is lower, the catalyzer temperature is lower, the exhaust temperature is lower, the volumetric efficiency is lower, the brake mean effective pressure is lower, the intake manifold pressure is lower, or the exhaust pressure is lower), the exhaust transport delay (which is greater, for example when the volume of the section of the exhaust system upstream of the $O_2$ sensor is greater, the exhaust flow rate is smaller, the engine speed Ne is lower, or the volumetric efficiency is lower), and the active state of the $O_2$ sensor 22 (which is worse, for example when the cooling water temperature is lower, the intake temperature is lower, the lubricating oil temperature is lower, the time which has passed after staring is shorter, the time for which the $O_2$ sensor heater has been supplied with a current is shorter, or the distance traveled is longer).

Alternatively, it may be so arranged that the standard value Sb for the output is set to be between the maximum and minimum values of the output of the $O_2$ sensor 22 or the $O_2$ sensor 220 with a catalyst detected in real time.

In the described embodiments, the ratio of the time for which the output of the oxygen sensor is greater than the standard value Sb for the output in the period T1 ("rich" time ratio), the value correlating with this time ratio, the ratio of the time for which the output of the oxygen sensor is smaller than the standard value Sb for the output in the period T1 ("lean" time ratio), or the value correlating with this time ratio is obtained. It is to be noted the value correlating with the time ratio includes the following values:

above-mentioned time ratio corrected on the basis of the period, amplitude and/or waveform of the modulation, the engine speed Ne and/or the exhaust flow rate (referred to as "the period, etc.")

time for which the output of the oxygen sensor is greater (or smaller) than the standard value Sb for the output (referred to as "output time")

$$\text{output time} = \text{time ratio} \times \text{period}$$

output time corrected on the basis of the period, etc.

ratio between the time for which the output of the oxygen sensor is greater than the standard value Sb for the output ("rich" output time) and the time for which it is smaller than the standard value Sb for the output ("lean" output time) (referred to as "R-L ratio")

$$R\text{-}L \text{ ratio} = (\text{"rich" output time})/(\text{"lean" output time}) \text{ or } (\text{"lean" output time})/(\text{"rich" output time})$$

value correlating with the R-L ratio

R-L ratio corrected on the basis of the period, etc.

value correlating with the R-L ratio corrected on the basis of the period, etc.

air/fuel ratio obtained from (and correlating with) the time ratio or value correlating with the time ratio air/fuel ratio obtained from (and correlating with) the time ratio or value correlating with the time ratio and corrected on the basis of the period, etc.

value correlating with the air/fuel ratio obtained from (and correlating with) the time ratio or value correlating with the time ratio (fuel/air ratio, equivalent ratio, excess air ratio)

value correlating with the air/fuel ratio obtained from (and correlating with) the time ratio or value correlating with the time ratio obtained and corrected on the basis of the period, etc.

When the air/fuel ratio obtained from the time ratio or value correlating with the time value is corrected, the air/fuel ratio is corrected to be richer or leaner.

Although in the described embodiments, the correction on the basis of the period, etc. is made to the time ratio, the correction may be made to the value correlating with the time ratio. Alternatively, the correction may be made to the target for the time ratio or the target for the value correlating with the time ratio. It is to be noted that when the correction on the basis of the period, etc. is made to the target for the time ratio or the target for the value correlating with the time ratio, the correction is made in the opposite direction to when the correction is made to the time ratio or the value correlating with the time ratio. Specifically, the target is corrected to be "greater" instead of "smaller", "smaller" instead of "greater", "leaner" instead of "richer", or "richer" instead of "leaner".

Although in the described embodiments, the air/fuel ratio of the exhaust is corrected on the basis of the difference between the time ratio or value correlating with the time ratio and the standard value for the ratio, the present invention is not limited to this. The benefits of the present invention can be enjoyed sufficiently, also when the air/fuel ratio of the exhaust is corrected according to the relation in magnitude between the time ratio or value correlating with the time ratio and the standard value for the ratio (depending on whether the former is greater than the latter or not, or whether the former is greater than or equal to or smaller than the latter).

Further, the air/fuel ratio may be corrected by increasing or decreasing the amount of fuel supplied, or changing the modulation ratio. For example, in order to correct the A/F ratio to be richer, the ratio of the "rich" modulation is made greater or the ratio of the "lean" modulation is made smaller, and in order to correct the A/F ratio to be leaner, the ratio of the "rich" modulation is made smaller or the ratio of the "lean" modulation is made greater.

The period, amplitude, waveform and modulation ratio of the modulation, the target for the time ratio and the target for the value correlating with the time ratio may be fixed. Alternatively, these may be changed appropriately according to the operating conditions (one or more of the factors consisting of engine speed Ne, vehicle speed, volumetric efficiency, intake air quantity, throttle opening, intake manifold pressure, exhaust temperature, $O_2$ sensor device temperature, $O_2$ sensor heater temperature, rate of change of engine speed, rate of change of vehicle speed, rate of change of volumetric efficiency, rate of change of intake air quantity, rate of change of throttle opening, rate of change of intake manifold pressure, cooling water temperature, oil temperature, intake air temperature, and the time which has passed after starting).

Further, using different specific values S1 and S2 in place of the standard value Sb for the output, the ratio between the time for which the output of the $O_2$ sensor 22 or the $O_2$ sensor 220 with a catalyst is greater than the specific value S1 and the time for which the output thereof is smaller than the specific value S2, or a value correlating with this ratio may be obtained.

Further, in place of the standard value Rb for the ratio, the standard value Rb1 for the ratio, and the standard value Rb2 for the ratio, different specific values R1 and R2, different specific values R11 and R12, and different specific values R21 and R22 may be used, respectively.

In the described embodiments, the time ratio, the "rich" time ratio and the "lean" time ratio are obtained in relation to the period T1 of the modulation according to equations (1), (2) and (3). Alternatively, the time ratio, the "rich" time ratio and the "lean" time ratio may be obtained in relation to an integer (including 1) times the period T1. Since the output of the $O_2$ sensor 22 or the $O_2$ sensor 220 with a catalyst varies periodically, according to the period of the modulation, the time ratio, the "rich" time ratio and the "lean" time ratio may be obtained in relation to the period T1 of the modulation or an integer times the period T1 (2T1, 3T1, . . . ). By this, the ratio of the time for which the output of the oxygen sensor is greater than the standard value Sb for the output or of the time for which it is smaller than the standard value Sb for the output to the time as a whole or a value correlating with this ratio can be properly obtained, so that the difference between the average exhaust A/F ratio and the target A/F ratio, namely how much the average exhaust A/F ratio departs from the target A/F ratio can be detected accurately, so that the exhaust A/F ratio can be adjusted properly.

Further, in the described embodiments, forcible modulation is performed so that the "lean" time and the "rich" time agree with specific times t1 and t2 so that the exhaust A/F ratio to be detected on the basis of the output of the $O_2$ sensor or the $O_2$ sensor with a catalyst can be within the A/F ratio detection range. However, the present invention is not restricted to this. Even when the exhaust A/F ratio to be detected on the basis of the output of the $O_2$ sensor or the $O_2$ sensor with a catalyst exceeds the A/F ratio detection range, the benefits of the present invention can be enjoyed sufficiently.

In the described embodiments, the $O_2$ sensor 20 or the $O_2$ sensor 220 with a catalyst is arranged upstream of the three-way catalytic converter 30. However, when the three-way catalytic converter 30 does not have a great capacity to store $O_2$, the $O_2$ sensor 22 or the $O_2$ sensor 220 with a catalyst may be arranged downstream of the three-way catalytic converter 30. In this instance, the atmosphere around the catalytic converter can be detected directly. Further, in a catalytic system which requires an $O_2$ sensor downstream of the catalytic converter for the OBD (on-board diagnosis), the cost is reduced because an $O_2$ sensor upstream of the catalytic converter can be omitted.

The catalytic converter is not limited to the three-way catalytic converter. As long as it has an $O_2$ storage function, any type of catalytic converter may be used.

In the described embodiments, the engine 1 is an MPI engine. However, the engine 1 is not limited to the MPI engine. As long as it allows forcible modulation control, any type of engine, for example a direct injection engine may be used as the engine 1.

The invention claimed is:

1. An exhaust purification device for internal combustion engine, comprising:

a catalytic converter provided in an exhaust passage of an internal combustion engine;

an air/fuel ratio forcibly modulating element for forcibly modulating the air/fuel ratio of exhaust flowing into the catalytic converter, between a lean air/fuel ratio leaner than a target average air/fuel ratio and a rich air/fuel ratio richer than the target average air/fuel ratio, with a specific period, a specific amplitude, a specific modulation ratio and a specific waveform;

an oxygen sensor provided in the exhaust passage for detecting the oxygen concentration of the exhaust and supplying an output corresponding to the detected oxygen concentration;

a time ratio calculating element for obtaining one of, a ratio of a time for which the output of the oxygen sensor is greater than a standard value for the output set between the maximum and minimum values of the output, a ratio of a time for which the output of the oxygen sensor is smaller than the standard value for the output, in a predetermined period of time, and a value correlating with the ratio; and an air/fuel ratio adjusting element for adjusting the air/fuel ratio of the exhaust during the forcible modulation, such that an actual average air/fuel ratio, obtained on the basis of one of the ratio and the value correlating with the ratio obtained by the time ratio calculating element, matches the target average air/fuel ratio, wherein the period of the modulation is set to be one of equal and shorter than a maximum period which ensures the air/fuel ratio to be detected on the basis of the output of the oxygen sensor does not reach one of the upper and lower limits of a range of air/fuel ratios detectable by the oxygen sensor.

2. The exhaust purification device for internal combustion engine according to claim 1, wherein the predetermined period of time is an integer times the period of the modulation.

3. The exhaust purification device for internal combustion engine according to claim 1, wherein the air/fuel ratio forcibly modulating element performs the forcible modulation so that the output of the oxygen sensor varies passing through a switch point of an output characteristic curve of the oxygen sensor.

4. The exhaust purification device for internal combustion engine according to claim 3, wherein the standard value for the output is set to one of an output value at the switch point and in the vicinity of the switch point.

5. The exhaust purification device for internal combustion engine according to claim 1, wherein the oxygen sensor has a catalytic function.

6. The exhaust purification device for internal combustion engine according to claim 1, wherein the air/fuel ratio adjusting element adjusts the air/fuel ratio of the exhaust during the forcible modulation, on the basis of one of a difference between the ratio and the value correlating with the ratio obtained by the time ratio calculating element and a standard value for the ratio.

7. The exhaust purification device for internal combustion engine according to claim 1, wherein the value correlating with the ratio is obtained, when the ratio is greater than the standard value for the ratio, by correcting the ratio in a manner such that the ratio is more increased when the period of the modulation is longer and more decreased when the period of the modulation is shorter, and when the ratio is smaller than the standard value for the ratio, by correcting the ratio in a manner such that the ratio is more decreased when the period of the modulation is longer and more increased when the period of the modulation is shorter.

8. The exhaust purification device for internal combustion engine according to claim 1, wherein the value correlating with the ratio is obtained, when the ratio is greater than the standard value for the ratio, by correcting the ratio in a manner such that the ratio is more increased when the amplitude of the modulation is greater and more decreased when the amplitude of the modulation is smaller, and when the ratio is smaller than the standard value for the ratio, by correcting the ratio in a manner such that the ratio is more decreased when the amplitude of the modulation is greater and more increased when the amplitude of the modulation is smaller.

9. The exhaust purification device for internal combustion engine according to claim 1, wherein the value correlating with the ratio is obtained, when the ratio is greater than the standard value for the ratio, by correcting the ratio in a manner such that the ratio is more increased when the waveform of the modulation is closer to a square wave and more decreased when the waveform of the modulation is further from the square wave, and when the ratio is smaller than the standard value for the ratio, by correcting the ratio in a manner such that the ratio is more decreased when the waveform of the modulation is closer to the square wave and more increased when the waveform of the modulation is further from the square wave.

10. The exhaust purification device for internal combustion engine according to claim 1, further comprising:

a rotational speed detecting element for detecting the rotational speed of the internal combustion engine, wherein the value correlating with the ratio is obtained, when the ratio is greater than the standard value for the ratio, by correcting the ratio in a manner such that the ratio is more increased when the rotational speed of the internal combustion engine detected by the rotational speed detecting element is higher and more decreased when the rotational speed is lower, and when the ratio is smaller than the standard value for the ratio, by correcting the ratio in a manner such that the ratio is more decreased when the rotational speed is higher and more increased when the rotational speed is lower.

11. The exhaust purification device for internal combustion engine according to claim 1, further comprising:

an exhaust flow rate detecting element for detecting the flow rate of the exhaust, wherein the value correlating with the ratio is obtained, when the ratio is greater than the standard value for the ratio, by correcting the ratio in a manner such that the ratio is more increased when the flow rate of the exhaust detected by the exhaust flow rate detecting element is greater and more decreased when the flow rate of the exhaust is smaller, and when the ratio is smaller than the standard value for the ratio, by correcting the ratio in a manner such that the ratio is more decreased when the flow rate of the exhaust is greater and more increased when the flow rate of the exhaust is smaller.

12. The exhaust purification device for internal combustion according to claim 1, wherein one of the standard value for the ratio of the time for which the output of the oxygen sensor is greater than the standard value for the output, and for the value correlating with the ratio is in the range of 0.5 to 0.75.

13. The exhaust purification device for internal combustion according to claim 1, wherein the standard value for the ratio of the time for which the output of the oxygen sensor is smaller than the standard value for one of the output and the value correlating with the ratio is in the range of 0.25 to 0.5.

14. The exhaust purification device for internal combustion according to claim 1, wherein the air/fuel ratio forcibly modulating element includes a change element for making change according to the operating states of the internal combustion engine, and the time ratio calculating element stores changed periods of the modulation in the past, and obtains the value correlating with the ratio, from one of the time for which the output of the oxygen sensor is greater than the standard value for the output and the time for which the output of the oxygen sensor is smaller than the standard value for the output, obtained this time, and a past changed period of the modulation stored.

15. The exhaust purification device for internal combustion according to claim 1, wherein the air/fuel ratio forcibly modulating element includes a change element for making change according to the operating states of the internal combustion engine, and the time ratio calculating element stores one of the time for which the output of the oxygen sensor was greater than the standard value for the output and the time for which the output of the oxygen sensor was smaller than the standard value for the output, obtained last time, and obtains the value correlating with the ratio, from one of the time for which the output of the oxygen sensor is greater than the standard value for the output, obtained this time, and the sum of the time for which the output of the oxygen sensor is greater than the standard value for the output, obtained this time, and the time for which the output of the oxygen sensor was smaller than the standard value for the output, obtained last time, and the time for which the output of the oxygen sensor is smaller than the standard value for the output, obtained this time, and the sum of the time for which the output of the oxygen sensor is smaller than the standard value for the output, obtained this time, and the time for which the output of the oxygen sensor was greater than the standard value for the output, obtained last time.

16. The exhaust purification device for internal combustion according to claim 1, wherein the average A/F is determined from a map.

* * * * *